US011976824B2

(12) United States Patent
Hayashi et al.

(10) Patent No.: US 11,976,824 B2
(45) Date of Patent: May 7, 2024

(54) CENTRIFUGAL FAN, AIR CONDITIONING APPARATUS, AND REFRIGERATION CYCLE APPARATUS

(71) Applicant: Mitsubishi Electric Corporation, Tokyo (JP)

(72) Inventors: Hiroyasu Hayashi, Tokyo (JP); Takuya Teramoto, Tokyo (JP); Ryo Horie, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 224 days.

(21) Appl. No.: 17/603,724

(22) PCT Filed: Jun. 13, 2019

(86) PCT No.: PCT/JP2019/023397
§ 371 (c)(1),
(2) Date: Oct. 14, 2021

(87) PCT Pub. No.: WO2020/250363
PCT Pub. Date: Dec. 17, 2020

(65) Prior Publication Data

US 2022/0196254 A1 Jun. 23, 2022

(51) Int. Cl.
*F04D 29/42* (2006.01)
*F04D 17/16* (2006.01)
(Continued)

(52) U.S. Cl.
CPC ..... *F24F 1/0022* (2013.01); *F04D 29/4226* (2013.01); *F04D 29/44* (2013.01)

(58) Field of Classification Search
CPC .... F24F 1/0022; F04D 29/4226; F04D 29/40; F04D 29/667; F04D 29/441; F04D 1/063; F04D 17/16; F04D 17/162
See application file for complete search history.

(56) References Cited

U.S. PATENT DOCUMENTS 3,407,995 A * 10/1968 Kinsworthy ..... F04D 17/162 415/206
5,156,524 A 10/1992 Forni
(Continued)

FOREIGN PATENT DOCUMENTS

CN 101451542 A 6/2009
CN 104343727 A 2/2015
(Continued)

OTHER PUBLICATIONS

English translation of KR100789817 by PE2E Jul. 11, 2023.*
(Continued)

*Primary Examiner* — Deming Wan
(74) *Attorney, Agent, or Firm* — POSZ LAW GROUP, PLC

(57) ABSTRACT

A centrifugal fan includes: an impeller having a back plate; and a scroll casing including a peripheral wall having a volute shape, a first side wall facing a virtual extension of the back plate and an inner end portion of the volute shape of the scroll casing, an expanded portion, and a first edge end portion being an end of a first edge defining the discharge port, of the first side wall, are arranged in a named order in the rotation direction, the first edge end portion being farther from the rotation shaft than an other end of the first edge and distance L1≥distance LM>distance LS is satisfied where LS is a distance between the first side wall at the inner end portion of the volute shape and the virtual extension of the back plate, LM is a distance between the first side wall at the expanded portion and the virtual extension of the back plate, the expanded portion being a portion at which the distance between the first side wall and the virtual extension of the back plate is larger than LS, and L1 is a distance between the first side wall at the first edge end portion and the virtual extension of the back plate.

18 Claims, 11 Drawing Sheets

(51) Int. Cl.

| | |
|---|---|
| ***F04D 29/06*** | (2006.01) |
| ***F04D 29/40*** | (2006.01) |
| ***F04D 29/44*** | (2006.01) |
| ***F04D 29/60*** | (2006.01) |
| ***F24F 1/0022*** | (2019.01) |

(56) References Cited

U.S. PATENT DOCUMENTS

| | | | | |
|---|---|---|---|---|
| 2002/0025253 | A1 | 2/2002 | Ozeki et al. | |
| 2003/0142476 | A1 | 7/2003 | Tomioka et al. | |
| 2009/0145583 | A1* | 6/2009 | Han | F04D 29/441 415/204 |
| 2015/0198178 | A1 | 7/2015 | Kawasaki | |
| 2017/0284413 | A1* | 10/2017 | Kim | F04D 17/162 |
| 2021/0033104 | A1 | 2/2021 | Teramoto et al. | |

FOREIGN PATENT DOCUMENTS

| | | | | |
|---|---|---|---|---|
| JP | S60-145497 | A | 7/1985 | |
| JP | S61-229999 | A | 10/1986 | |
| JP | 2002-048097 | A | 2/2002 | |
| JP | 2003-222098 | A | 8/2003 | |
| JP | 2007-127089 | A | 5/2007 | |
| JP | 2007-291877 | A | 11/2007 | |
| JP | 2015-028299 | A | 2/2015 | |
| JP | 2016-196208 | A | 11/2016 | |
| KR | 100789817 | B1 * | 4/2002 | F04D 29/44 |
| WO | 2008/068959 | A1 | 6/2008 | |
| WO | WO-2014034950 | A1 * | 3/2014 | F04D 17/16 |
| WO | 2019/082392 | A1 | 5/2019 | |

OTHER PUBLICATIONS

English translation of WO2014034950 by PE2E Jul. 11, 2023.*
Examination Report dated Apr. 28, 2022 issued in corresponding IN Patent Application No. 202127050087 (and English translation).
Extended European Search Report dated May 16, 2022 issued in corresponding European Patent Application No. 19932455.9.
International Search Report of the International Searching Authority dated Sep. 10, 2019 in corresponding International Patent Application No. PCT/JP2019/023397 (and English translation).
Office Action dated Dec. 25, 2020, issued in corresponding TW Patent Application No. 10921254870 (and English machine translation).
Office Action dated May 4, 2021, issued in corresponding TW Patent Application No. 11020412650 (and English machine translation).
Office Action dated Aug. 16, 2021, issued in corresponding TW Patent Application No. 11020793570 (and English machine translation).
Office Action dated Jul. 12, 2022 issued in corresponding JP Patent Application No. 2021-525492 (and English translation).
Examination Report dated Mar. 20, 2023 issued in corresponding AU patent application No. 2019450775.
Office Action dated Jul. 27, 2023 issued in corresponding CN patent application No. 201980097191.9 (and Machine translation).
Office Action dated Mar. 8, 2024 issued in corresponding CN Patent Application No. 201980097191.9 (and English translation).
Office Action dated Mar. 5, 2024 issued in corresponding Japanese Patent Application No. 2021-525492 (and English translation).

* cited by examiner

CENTRIFUGAL FAN, AIR CONDITIONING APPARATUS, AND REFRIGERATION CYCLE APPARATUS

CROSS REFERENCE TO RELATED APPLICATION

This application is a U.S. national stage application of PCT/JP2019/023397 filed on Jun. 13, 2019, the contents of which are incorporated herein by reference.

TECHNICAL FIELD

The present disclosure relates to a centrifugal fan including a scroll casing, an air-conditioning apparatus including the centrifugal fan, and a refrigeration cycle apparatus including the centrifugal fan.

BACKGROUND ART

In existing centrifugal fans, air blown out by rotation of an impeller flows, from an inner end portion of a scroll peripheral wall having a volute shape to a discharge port, in a casing whose scroll peripheral wall is expanded in a radial direction of the impeller, and the air pressure thus increases. However, in terms of mounting such an existing centrifugal fan in a unit, there sometimes arise restrictions on expansion of a scroll peripheral wall in a radial direction. To address this, there has been proposed a centrifugal fan in which the sectional area of a passage in a scroll casing is increased with expansion of a scroll peripheral wall in a radial direction inhibited by expanding a scroll side wall in the rotation axis direction of an impeller in addition to expansion of the scroll peripheral wall in the radial direction (see, for example, Patent Literature 1). In the centrifugal fan in Patent Literature 1, the scroll side wall is gradually expanded from an inner end portion in the rotation direction of the impeller, and the height of the scroll side wall is gradually reduced from a most expanded portion in a direction toward the inner end portion. As a result, the centrifugal fan in Patent Literature 1 is capable of smoothly guiding air flowing again to a tongue portion in addition to achieving a pressure increase effect.

CITATION LIST

Patent Literature

Patent Literature 1: Japanese Unexamined Patent Application Publication No. 2007-127089

SUMMARY OF INVENTION

Technical Problem

However, in the centrifugal fan in Patent Literature 1 the height of the scroll side wall is reduced from the most expanded portion of the scroll side wall in the direction toward the inner end portion, and the height of the part of the side wall toward a discharge port is also reduced. Thus, the velocity of airflow may be increased due to a reduction in the sectional area of the passage in the centrifugal fan in Patent Literature 1 from the most expanded portion toward the discharge port. Accordingly, there is a problem in that the airflow pressure cannot be efficiently increased.

The present disclosure is made to solve such a problem, and an object of the present disclosure is to obtain a centrifugal fan, an air-conditioning apparatus, and a refrigeration cycle apparatus that are capable of efficiently increasing airflow pressure with a side wall expanded in the rotation axis direction of an impeller.

Solution to Problem

A centrifugal fan according to an embodiment of the present disclosure includes: an impeller having a back plate driven to rotate; and a scroll casing including a peripheral wall provided in parallel with an axial direction of a rotation shaft of the back plate to surround the impeller, and having a volute shape along a rotation direction of the back plate, a first side wall extending along a first edge of the peripheral wall, the first edge being at one end, in the axial direction of the rotation shaft, of the peripheral wall, the first side wall facing a virtual extension of the back plate, the virtual extension of the back plate being perpendicular to the rotation shaft, the first side wall having a first air inlet defined therein and configured to let air in, and a discharge port from which airflow generated by the impeller is discharged. The scroll casing is configured such that an inner end portion of the volute shape of the scrod casing, an expanded portion, and a first edge end portion are arranged in a named order in the rotation direction, the first edge end portion being an end of a first edge, defining the discharge port, of the first side wall, the first edge end portion being farther from the rotation shaft than an other end of the first edge is to the rotation shaft, and distance L1≥distance LM>distance LS is satisfied where LS is a distance between the first side wall at the inner end portion of the volute shape and the virtual extension of the back plate, LM is a distance between the first side wall at the expanded portion and the virtual extension of the back plate, the expanded portion being a portion at which the distance between the first side wall and the virtual extension of the back plate is larger than LS, and L1 is a distance between the first side wall at the first edge end portion and the virtual extension of the back plate.

An air-conditioning apparatus according to another embodiment of the present disclosure includes the centrifugal fan and a heat exchanger provided to face the discharge port of the centrifugal fan.

A refrigeration cycle apparatus according to still another embodiment of the present disclosure includes the centrifugal fan.

Advantageous Effects of Invention

According to the embodiments of the present disclosure, the scroll casing of the centrifugal fan is configured such that the inner end portion, the expanded portion, and the first edge end portion are arranged in a named order in the rotation direction and such that distance L1=distance LM>distance LS is satisfied. As a result, air flowing in the scroll casing flows toward the discharge port with the pressure thereof increasing along with expansion of the scroll side wall. In addition, part of the air toward the inner end portion can smoothly flow again to the inner end portion due to the height of the first side wall being reduced such that distance LM>distance LS is satisfied. Furthermore, the scroll casing is configured such that distance L1≥distance LM is satisfied. Thus, the scroll casing is configured without the sectional area of the passage reduced from the expanded portion toward the discharge port. Accordingly, the centrifugal fan, the air-conditioning apparatus, and the refrigeration cycle apparatus having this configuration are capable of efficiently increasing airflow pressure with expansion of the side wall.

DESCRIPTION OF EMBODIMENTS

A centrifugal fan 1 according to an embodiment of the present disclosure will be described below with reference to the drawings, for example. In addition, an air-conditioning apparatus 40 and a refrigeration cycle apparatus 50 according to embodiments of the present disclosure will be described with reference to the drawings, for example. For example, the relative size relationships or the shapes of the components in the following drawings including FIG. 1 may differ from those of actual ones. In the following drawings, components having the same reference signs are the same or corresponding components, and this applies to the entire description. Terms that mean directions (for example. "up", "down", "right", "left", "forward", and "backward") are used as appropriate to make the description easy to understand. However, these terms are merely used for convenience of description and do not limit the dispositions and the orientations of apparatuses or components.

Embodiment 1

[Centrifugal Fan 1]

Figure 1:
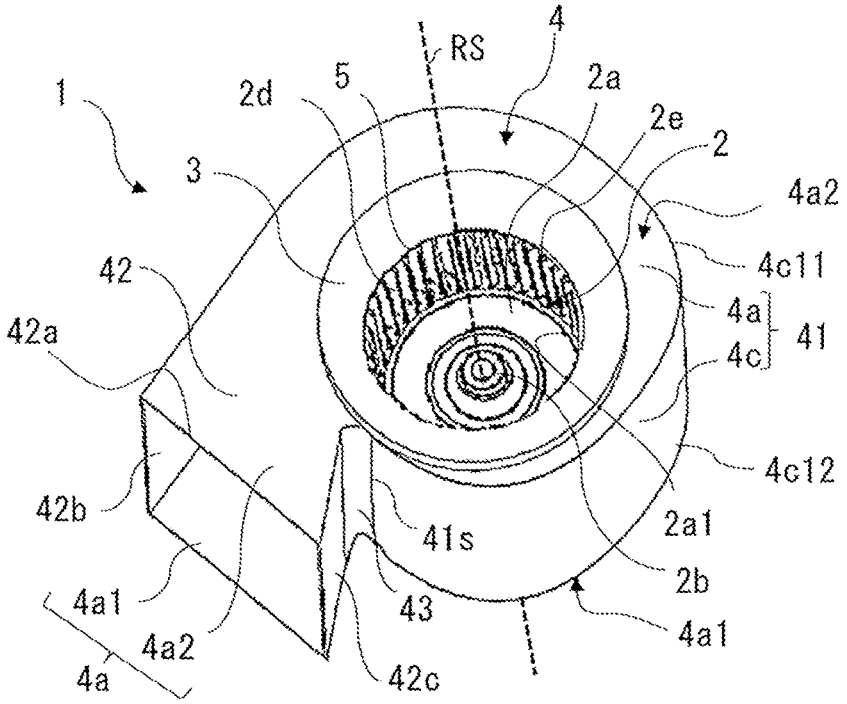
FIG. 1 is a perspective view of a centrifugal fan according to Embodiment 1.
Figure 2:
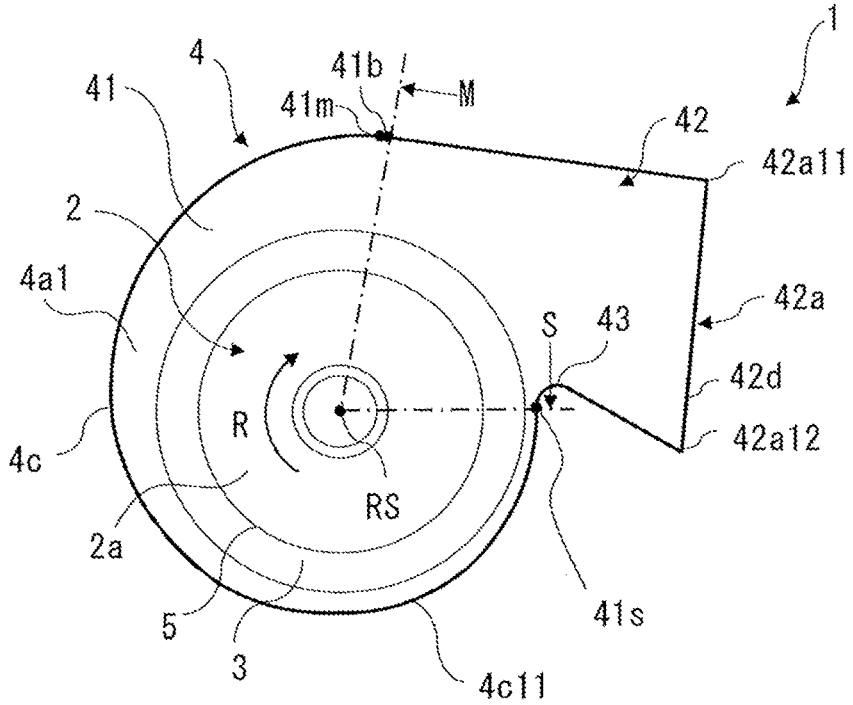
FIG. 2 is a schematic diagram of the centrifugal fan according to Embodiment 1 when viewed in a direction along a rotation shaft RS.
Figure 3:
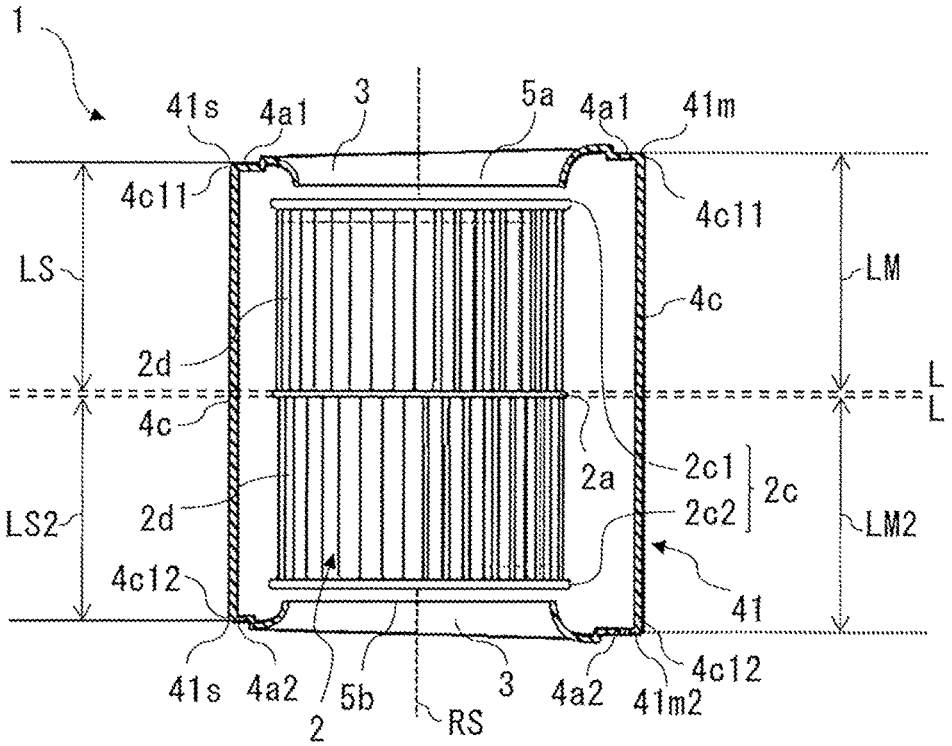
FIG. 3 is a sectional view of the centrifugal fan in FIG. 2 taken along line S-M.
Figure 4:
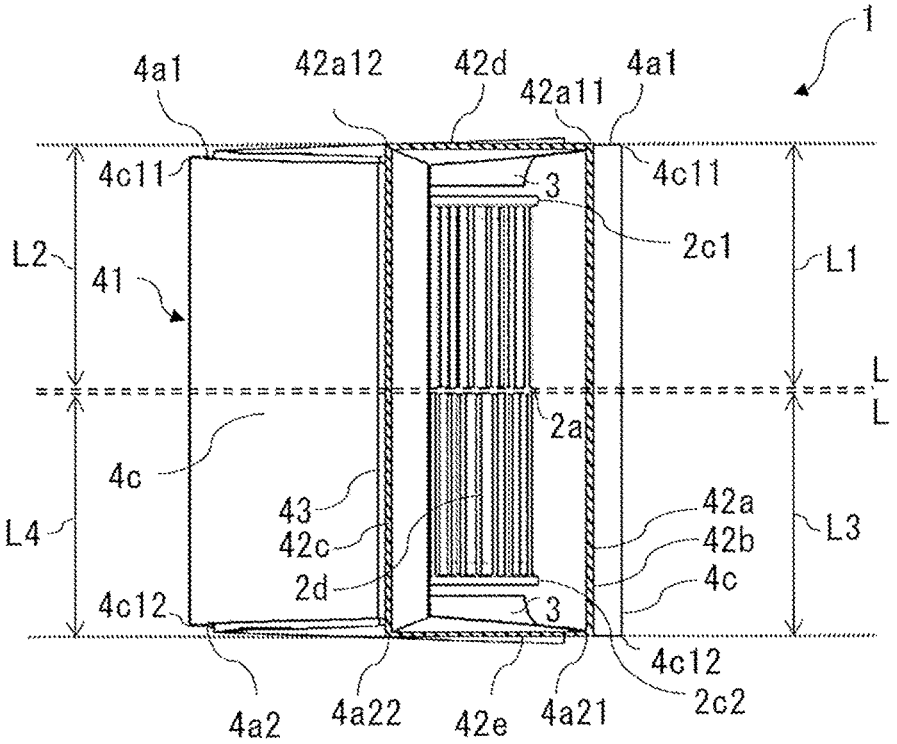
FIG. 4 is a side view of the centrifugal an according to Embodiment 1 when viewed in a direction from a discharge port.

FIG. 1 is a perspective view of the centrifugal fan 1 according to Embodiment 1. FIG. 2 is a schematic diagram of the centrifugal fan 1 according to Embodiment 1 when viewed in a direction along a rotation shaft RS. FIG. 3 is a sectional view of the centrifugal fan 1 in FIG. 2 taken along line S-M. FIG. 4 is a side view of the centrifugal fan 1 according to Embodiment 1 when viewed in a direction from a discharge port. The centrifugal fan 1 is a double suction centrifugal fan 1, into which air is suctioned from both end sides thereof in the direction along the rotation shaft RS of an impeller 2. A side opposite to the side of the centrifugal fan 1 illustrated in FIG. 1 has a similar configuration. Thus, the configuration of the centrifugal fan 1 is described by using FIG. 1, and the configuration of the side opposite to the side of the centrifugal fan 1 in FIG. 1 is not illustrated.

First, the basic structure of the centrifugal fan 1 will be described by using FIGS. 1 to 4. The centrifugal fan 1 is, for example, a multiblade centrifugal fan 1, such as a sirocco fan or a turbo fan. The centrifugal fan 1 includes the impeller 2, which is configured to generate airflow, and a scroll casing 4, which accommodates the impeller 2.

(Impeller 2)

The impeller 2 is driven to rotate by, for example, a motor (not illustrated) and forcibly sends air outward in radial directions with the centrifugal force generated by the rotation. As illustrated in FIGS. 1 and 2, the impeller 2 has a back plate 2*a*, which has a disk shape, and a plurality of blades 2*d*, which are provided on a peripheral portion 2*a*1 of the back plate 2*a*. The back plate 2*a* may have any shape, such as a polygonal shape, other than a disk shape as long as the back plate 2*a* has a plate-like shape. An axial portion 2*b*, to which the motor (not illustrated) is connected, is provided at the center of the back plate 2*a*. The back plate 2*a* is driven to rotate by the motor via the axial portion 2*b*.

The blades 2*d* are provided on the circumference around the axial portion 2*b*. The base ends of the blades 2*d* are fixed to the back plate 2*a*. The blades 2*d* are provided on both sides of the back plate 2*a* in the axial direction of the rotation shaft RS of the impeller 2. The blades 2*d* are provided on the peripheral portion 2*a*1 of the back plate 2*a* with certain spaces therebetween. The blades 2*d* each have, for example, a curved rectangular plate-like shape and are each provided to extend in a radial direction or to be inclined at a predetermined angle relative to a radial direction. The blades 2*d* are each formed into a two-dimensional blade in which the same sectional shape is continuous in the axial direction of the rotation shaft RS but may be each formed into a three-dimensional blade having a twisted shape. The blades 2*d* are provided to stand substantially perpendicularly to the back plate 2*a*, but the configuration thereof is not limited thereto. The blades 2*d* may be provided to be inclined relative to a direction perpendicular to the back plate 2*a*.

As illustrated in FIGS. 3 and 4, the impeller 2 has side plates 2*c*, each of which has an annular shape and is attached to the corresponding end portion opposite to the back plate 2*a* of the blades 2*d* in the axial direction of the rotation shaft RS. The side plates 2*c* maintain the positional relationship between the tips of the blades 2*d* and reinforce the blades 2*d* by being connected to the blades 2*d*. Thus, one end of each of the blades 2*d* is connected to the back plate 2*a*, the other end of each of the blades 2*d* is connected to the corresponding side plate 2*c*, and the blades 2*d* are provided between the back plate 2*a* and the side plates 2*c*.

As illustrated in FIG. 1, the impeller 2 has a cylindrical shape due to the blades 2*d* provided on the back plate 2*a*. At respective positions closer to the side plates 2*c* opposite to the back plate 2*a* in the axial direction of the rotation shaft RS, the impeller 2 has air inlets 2*e* for allowing gas to flow therethrough into the spaces surrounded by the back plate 2*a* and the blades 2*d*. In the impeller 2, the blades 2*d* and the side plate 2*c* are provided at each side of the back plate 2*a*, and the air inlet 2*e* is formed at each side of the back plate 2*a*.

The impeller 2 is driven to rotate around the rotation shaft RS by driving the motor (not illustrated). By rotating the impeller 2, gas outside the centrifugal fan 1 is suctioned into the spaces surrounded by the back plate 2*a* and the blades 2*d* through air inlets 5, which are formed in the scroll casing 4, and the air inlets 2*e* of the impeller 2. By rotating the impeller 2, the air suctioned into the spaces surrounded by the back plate 2*a* and the blades 2*d* is then sent outward in a radial direction through a space between each blade 2*d* and the corresponding adjacent blade 2*d*.

(Scroll Casing 4)

As illustrated in FIG. 1, the scroll casing 4 accommodates the impeller 2 and rectifies the flow of air blown out from the impeller 2. The scroll casing 4 includes a scroll portion 41 and a discharge portion 42.

(Scroll Portion 41)

The scroll portion 41 defines an air passage in which the dynamic pressure of airflow generated by the impeller 2 is converted into a static pressure. The scroll portion 41 includes side walls 4*a*, which have the respective air inlets 5 defined therein and configured to let air in and which surround the impeller 2 in the axial direction of the rotation shaft RS of the axial portion 2*b* forming the impeller 2, and a peripheral wall 4*c*, which surrounds the impeller 2 in radial directions of the rotation shaft RS of the axial portion 2*b* forming the impeller 2. In addition, the scroll portion 41 includes a tongue portion 43, which has a curved surface between the discharge portion 42 and an inner end portion 41*s* of the peripheral wall 4*c* and which is a restriction portion required for blowing out, in a centrifugal direction, the air that has flowed in through the air inlets 5 and increasing the air pressure. A radial direction of the rotation shaft RS is a direction perpendicular to the rotation shaft RS. The internal space of the scroll portion 41 formed by the peripheral wall 4*c* and the side walls 4*a* is a space in which the air that has blown out from the impeller 2 flows along the peripheral wall 4*c*.

(Side Walls 4*a*)

As illustrated in FIGS. 1 and 3, the side wall 4*a* is provided at each side of the impeller 2 in the axial direction of the rotation shaft RS of the impeller 2. The side walls 4*a* of the scroll casing 4 have the respective air inlets 5 for letting air in such that air can flow between the impeller 2 and the outside of the scroll casing 4. The air inlets 5 each have a circular shape. The impeller 2 is provided such that the center of each of the air inlets 5 substantially coincides with the center of the axial portion 2*b* of the impeller 2. The shape of the air inlet 5 is not limited to a circular shape and may be a different shape such as an oval shape. The scroll casing 4 of the centrifugal fan 1 is a double suction casing including the side wall 4*a* having the air inlet 5 at each side of the back plate 2*a* in the axial direction of the rotation shaft RS of the impeller 2. In the centrifugal fan 1, the scroll casing 4 includes two side walls 4*a*, and the side walls 4*a* are provided to face each other.

As illustrated in FIG. 1, the scroll casing 4 includes, as the side walls 4*a*, a first side wall 4*a*1 and a second side wall 4*a*2. The first side wall 4*a*1 extends along a first edge 4*c*11 of the peripheral wall 4*c*, the first edge 4*c*11 being at one end, in the axial direction of the rotation shaft RS, of the peripheral wall 4*c*, and the first side wall 4*a*1 faces a virtual extension L of the back plate 2*a*, the virtual extension L of the back plate 2*a* being perpendicular to the rotation shaft RS. The second side wall 4*a*2 extends along a second edge 4*c*12 of the peripheral wall 4*c*, the second edge 4*c*12 being at the other end, in the axial direction of the rotation shaft RS, of the peripheral wall 4*c*, and the second side wall 4*a*2 faces the extension L. As illustrated in FIGS. 3 and 4, the first side wall 4*a*1 defines a first air inlet 5*a*, which faces the surface of the back plate 2*a* closer to the position where a first side plate 2*c*1 is provided. The second side wall 4*a*2 defines a second air inlet 5*b*, which faces the surface of the back plate 2*a* closer to the position where a second side plate 2*c*2 is provided. The term "air inlets 5" described above is a general term for the first air inlet 5*a* and the second air inlet 5*b*.

As illustrated in FIGS. 1 and 2, the air inlets 5 provided in the respective side walls 4*a* are formed by bell mouths 3. The bell mouths 3 rectify the flow of gas to be suctioned into the impeller 2 and allow the gas to flow therethrough into the air inlets 2*e* of the impeller 2. As illustrated in FIG. 3, the bell mouths 3 are configured such that the opening diameter is gradually reduced from the outside toward the inside of the scroll casing 4. With the configuration of the side walls 4*a*, air near the air inlets 5 flows smoothly and efficiently into the impeller 2 from the air inlets 5.

(Peripheral Wall 4*c*)

The peripheral wall 4*c* guides, along a curved wall surface thereof, airflow generated by the impeller 2 to a discharge port 42*a* via the scroll portion 41. The peripheral wall 4*c* is a wall provided between the side walls 4*a* facing each other and has a curved surface in a rotation direction R of the impeller 2. For example, the peripheral wall 4*c* is provided in parallel with the axial direction of the rotation shaft RS of the impeller 2 to surround the impeller 2. The peripheral wall 4*c* may be inclined relative to the axial direction of the rotation shaft RS of the impeller 2 and is not limited to the peripheral wall 4*c* provided in parallel with the axial direction of the rotation shaft RS. The peripheral wall 4*c* surrounds the impeller 2 in radial directions of the rotation shaft RS and has an inner circumferential surface facing the blades 2*d*. The peripheral wall 4*c* faces the air discharge sides of the blades 2*d* of the impeller 2. As illustrated in FIG. 2, the peripheral wall 4*c* is provided to extend from the inner end portion 41*s* positioned at the boundary between the peripheral wall 4*c* and the tongue portion 43 to an outer end portion 41*b* positioned at the boundary between the scroll portion 41 and the discharge portion 42 farther from the tongue portion 43 in the rotation direction R of the impeller 2. The inner end portion 41*s* is an end portion of the peripheral wall 4*c* having the curved surface, the end portion being upstream for airflow generated by rotation of the impeller 2. The outer end portion 41*b* is an end portion of the peripheral wall 4*c* having the curved surface, the end portion being downstream for airflow generated by rotation of the impeller 2.

The peripheral wall 4*c* has a volute shape along the rotation direction R. Examples of such a volute shape include volute shapes based on a logarithmic spiral, an Archimedean spiral, and an involute curve. The inner circumferential surface of the peripheral wall 4*c* is a surface smoothly curved in the circumferential direction of the impeller 2 from the inner end portion 41*s*, which is an inner end of the volute shape, to the outer end portion 41*b*, which is an outer end of the volute shape. With such a configuration, the air sent out from the impeller 2 flows smoothly between the impeller 2 and the peripheral wall 4*c* in a direction toward the discharge portion 42. Thus, in the scroll casing 4, the static pressure of air increases efficiently from the tongue portion 43 toward the discharge portion 42.

(Discharge Portion 42)

The discharge portion 42 defines the discharge port 42*a* from which the airflow that has been generated by the impeller 2 and that has passed through the scroll portion 41 is discharged. The discharge portion 42 is made of a hollow pipe whose section orthogonal to a direction in which air flows along the peripheral wall 4*c* has a rectangular shape. The discharge portion 42 defines a passage for guiding, to be discharged to the outside of the scroll casing 4, the air that flows between the peripheral wall 4*c* and the impeller 2 after being sent out from the impeller 2.

As illustrated in FIG. 1, the discharge portion 42 is formed by an extended plate 42*b*, a diffuser plate 42*c*, the first side wall 4*a*1, and the second side wall 4*a*2. The extended plate 42*b* is integrally formed with the peripheral wall 4*c* to be smoothly continuous with the outer end portion 41*b*, which is downstream in the peripheral wall 4*c*. The diffuser plate 42*c* is integrally formed with the tongue portion 43 of the scroll casing 4 and faces the extended plate 42*b*. The diffuser plate 42*c* is configured to form a predetermined angle with the extended plate 42*b* such that the sectional area of the passage increases gradually in the direction in which air flows in the discharge portion 42. The extended plate 42*b* and the diffuser plate 42*c* are formed between the first side wall 4*a*1 and the second side wall 4*a*2. In such a manner, the discharge portion 42 has the passage whose section has a rectangular shape and that is defined by the extended plate 42*b*, the diffuser plate 42*c*, the first side wall 4*a*1, and the second side wall 4*a*2.

(Tongue Portion 43)

The scroll casing 4 has the tongue portion 43 between the diffuser plate 42*c* of the discharge portion 42 and the inner end portion 41*s* of the peripheral wall 4*c*. The tongue portion 43 is formed with a predetermined curvature radius. The peripheral wall 4*c* is smoothly continuous with the diffuser plate 42*c* via the tongue portion 43. The tongue portion 43 inhibits air from flowing from the outer end into the inner end of the volute-shaped passage. The tongue portion 43 is provided in an upstream section of the air passage and has a function of separating air flowing in the rotation direction R of the impeller 2 and air flowing in the discharge direction from a downstream section of the air passage toward the discharge port 42*a*. In addition, the static pressure of air flowing into the discharge portion 42 increases during the air passing through the scroll casing 4 and becomes higher than that in the scroll casing 4, Thus, the tongue portion 43 has a function of separating areas different from each other in pressure as described above.

(Specific Configuration of Scroll Casing 4)

Figure 5:
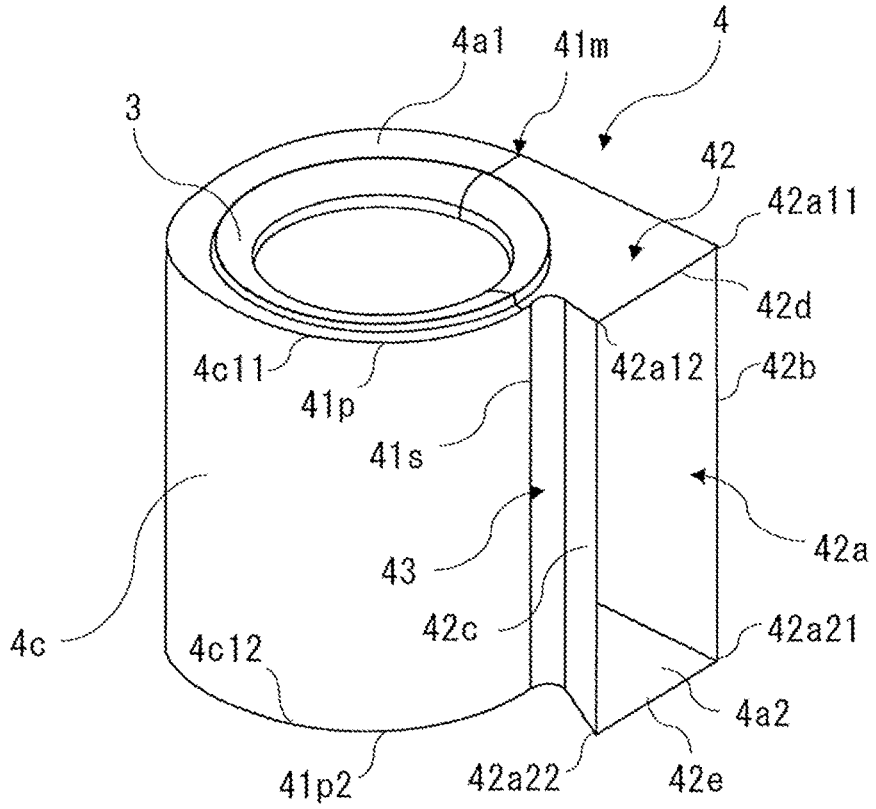
FIG. 5 is a perspective view of a scroll casing of the centrifugal fan according to Embodiment 1.
Figure 6:
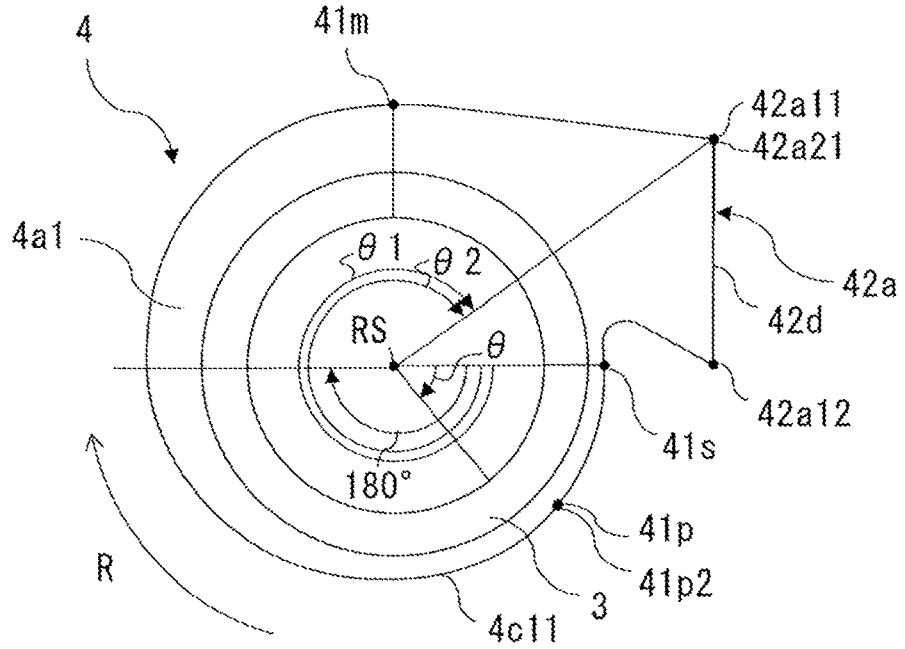
FIG. 6 is a schematic diagram of the scroll casing in FIG. 5 when viewed in the direction along the rotation shaft RS.

FIG. 5 is a perspective view of the scroll casing 4 of the centrifugal fan 1 according to Embodiment 1. FIG. 6 is a schematic diagram of the scroll casing 4 in FIG. 5 when viewed in the direction along the rotation shaft RS. The specific configuration of the side walls 4*a* will be described by using FIGS. 3 to 6.

Here, as illustrated in FIGS. 3, 5, and 6, a distance LS is the distance between the first side wall 4*a*1 at the inner end portion 41*s* of the volute shape and the extension L. An expanded portion 41*m* is a portion at which the distance between the first side wall 4*a*1 and the extension L is larger than the distance LS. A distance LM is the distance between the first side wall 4*a*1 at the expanded portion 41*m* and the extension L. As illustrated in FIG. 6, the expanded portion 41*m* is formed between, in the rotation direction R of the impeller 2, a position at 180 degrees relative to the inner end portion 41*s* and a position where the line connecting the rotation shaft RS and a first edge end portion 42*a*11 forms a first angle θ1.

Next, as illustrated in FIGS. 4, 5, and 6, a distance L1 is the distance between the first side wall 4*a*1 at the first edge end portion 42*a*11 and the extension L, the first edge end portion 42*a*11 being an end of a first edge 42*d*, defining the discharge port 42*a*, of the first side wall 4*a*1, the first edge end portion 42*a*11 being farther from the rotation shaft RS than the other end of the first edge 42*d* is to the rotation shaft RS. A distance L2 is the distance between the first side wall 4*a*1 at a second edge end portion 42*a*12 and the extension L, the second edge end portion 42*a*12 being the other end of the first edge 42*d*, the second edge end portion 42*a*12 being closer to the rotation shaft RS.

The scroll casing 4 is configured such that the inner end portion 41*s*, the expanded portion 41*m*, and the first edge end portion 42*a*11 are arranged in a named order in the rotation direction R and such that distance L1≥Ldistance LM≥distance LS is satisfied. Preferably, the scroll casing 4 is configured such that distance L1L-distance L2≥distance LS is satisfied.

Figure 7:
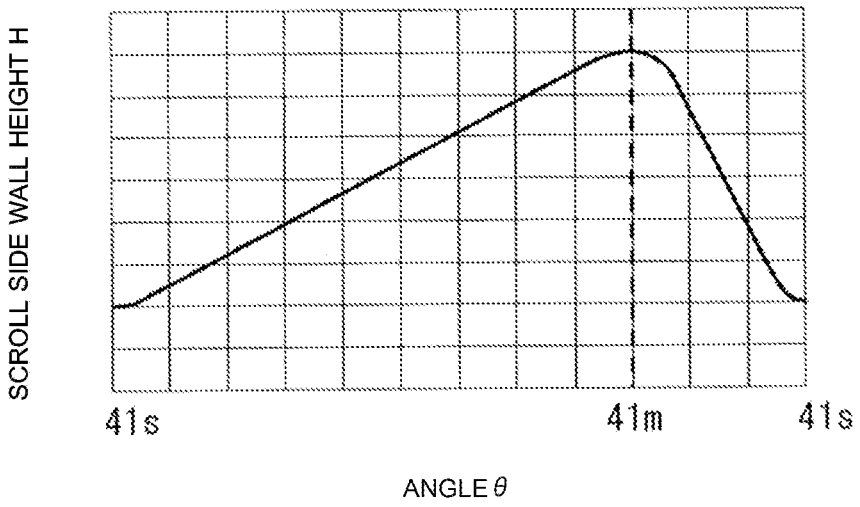
FIG. 7 is a graph illustrating a relationship between a scroll side wall height H and an angle θ in a scroll portion.

FIG. 7 is a graph illustrating a relationship between a scroll side wall height H and an angle θ in the scroll portion 41. The relationship between a scroll side wall height H and an angle θ in the scroll portion 41 will be described by using FIG. 7. The scroll side wall height H illustrated in FIG. 7 is a distance between the side wall 4*a* and the extension L. The angle θ is an angle, in the rotation direction R of the impeller 2, whose starting point is the inner end portion 41*s*, As illustrated in FIG. 7, the scroll casing 4 is configured such that the scroll side wall height H increases in the rotation direction R from the inner end portion 41*s* to the expanded portion 41*m*. Thus, the scroll casing 4 is configured such that the distance between the first side wall 4*a*1 and the extension L gradually increases in the rotation direction R of the impeller 2 from the inner end portion 41*s* toward the expanded portion 41*m*.

In addition, as illustrated in FIG. 7, the scroll casing 4 is configured such that the scroll side wall height H reduces in the rotation direction R from the expanded portion 41*m* to the inner end portion 41*s*. Thus, the scroll casing 4 is configured such that the distance between the first side wall 4*a*1 and the extension L gradually reduces in the rotation direction R of the impeller 2 from the expanded portion 41*m* toward the inner end portion 41*s*.

Figure 8:
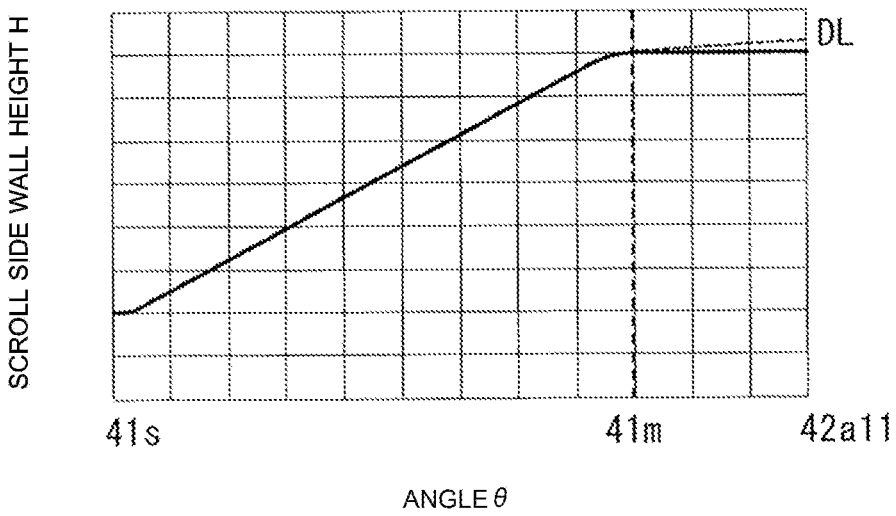
FIG. 8 is a graph illustrating a relationship between a scroll side wall height H and an angle θ in the scroll portion and a discharge portion.

FIG. 8 is a graph illustrating a relationship between a scroll side wall height H and an angle θ in the scroll portion 41 and the discharge portion 42. The relationship between a scroll side wall height H and an angle θ in the scroll portion 41 and the discharge portion 42 will be described by using FIG. 7. As illustrated in FIG. 8, the scroll casing 4 is configured such that the scroll side wall height H increases in the rotation direction R from the inner end portion 41*s* to the expanded portion 41*m*. Thus, the scroll casing 4 is configured such that the distance between the first side wall 4*a*1 and the extension L gradually increases in the rotation direction R of the impeller 2 from the inner end portion 41*s* toward the expanded portion 41*m*.

In addition, as illustrated in FIG. 8, the scroll casing 4 is configured such that the scroll side wall height H is constant from the expanded portion 41*m* to the first edge end portion 42*a*11. Thus, the scroll casing 4 is configured such that the distance between the first side wall 4*a*1 and the extension L is constant from the expanded portion 41*m* toward the first edge end portion 42*a*11.

Furthermore, as represented by a dashed line DL in FIG. 8, the scroll casing 4 may be configured such that the scroll side wall height H increases from the expanded portion 41*m* to the first edge end portion 42*a*11. Thus, the scroll casing 4 may be configured such that the distance between the first side wall 4*a*1 and the extension L increases from the expanded portion 41*m* toward the first edge end portion 42*a*11.

As illustrated in FIGS. 7 and 8, the scroll casing 4 is configured such that the distance between the first side wall 4*a*1 and the extension L gradually increases in the rotation direction R of the impeller 2 from the inner end portion 41*s* toward the expanded portion 41*m*.

Figure 9:
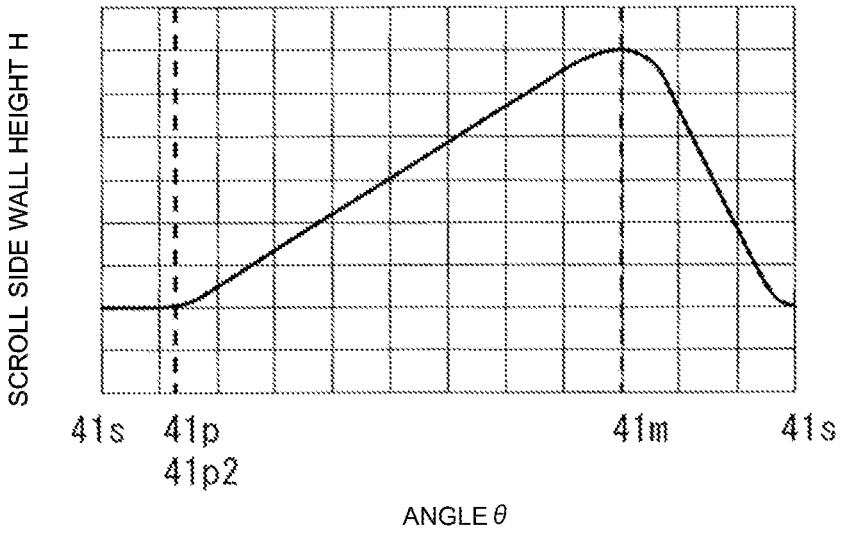
FIG. 9 is a graph illustrating a relationship between a scroll side wall height H and an angle θ in a scroll portion of a modified scroll casing.

FIG. 9 is a graph illustrating a relationship between a scroll side wall height H and an angle θ in a scroll portion 41 of a modified scroll casing 4. The configuration from the expanded portion 41*m* toward the first edge end portion 42*a*11 in the modified scroll casing 4 is the same as the configuration illustrated in FIG. 8.

An expansion start portion 41*p* is a portion at which the distance between the first side wall 4*a*1 and the extension L starts to increase in the rotation direction R of the impeller 2. In the modified scroll casing 4, when the angle at the position of the inner end portion 41*s* is 0 degrees, the expansion start portion 41*p* is formed between a position at 0 degrees and a position at 180 degrees in the rotation direction R.

Thus, the modified scroll casing 4 is configured such that the inner end portion 41*s*, the expansion start portion 41*p*, the expanded portion 41*m*, and the first edge end portion 42*a*11 are arranged in a named order in the rotation direction R and such that distance L1≥distance LM>distance LS is satisfied. Similarly to the scroll casing 4 described above, preferably, the modified scroll casing 4 is configured such that distance L1≥distance L2≥distance LS is satisfied.

The relationship between the first side wall 4*a*1 and the virtual extension L has been described above. This relationship also applies to the relationship between the second side wall 4*a*2 and the virtual extension L. Thus, as illustrated in FIG. 3, a distance LS2 is the distance between the second side wall 4*a*2 at the inner end portion 41*s* of the volute shape and the extension L. A second expanded portion 41*m*2 is a portion at which the distance between the second side wall 4*a*2 and the extension L is larger than the distance LS2. A distance LM2 is the distance between the second side wall 4*a*2 at the second expanded portion 41*m*2 and the extension L. The second expanded portion 41*m*2 is formed between, in the rotation direction R of the impeller 2, a position at 180 degrees relative to the inner end portion 41*s* and a position where the line connecting the rotation shaft RS and a third edge end portion 42*a*21 forms a second angle θ2. The second expanded portion 41*m*2 and the expanded portion 41*m* may be formed at the same position or different positions in the rotation direction R. That is, the first angle θ1 and the second angle θ2 may be equal or unequal.

Next, as illustrated in FIG. 4, a distance L3 is the distance between the second side wall 4*a*2 at the third edge end portion 42*a*21 and the extension L, the third edge end portion 42*a*21 being an end of a second edge 42*e*, defining the discharge port 42*a*, of the second side wall 4*a*2, the third edge end portion 42*a*21 being farther from the rotation shaft RS than the other end of the second edge 42*e* is to the rotation shaft RS. A distance L4 is the distance between the second side wall 4*a*2 at a fourth edge end portion 42*a*22 and the extension L, the fourth edge end portion 42*a*22 being the other end of the second edge 42*e*, the fourth edge end portion 42*a*22 being closer to the rotation shaft RS.

The scroll casing 4 is configured such that the inner end portion 41*s*, the second expanded portion 41*m*2, and the third edge end portion 42*a*21 are arranged in a named order in the rotation direction R and such that distance L3-distance LM2>distance LS2 is satisfied. Preferably, the scroll casing 4 is configured such that distance L3≥distance L4≥distance LS2 is satisfied.

The relationship between a scroll side wall height H and an angle θ in the scroll portion 41 illustrated in FIGS. 7 and 8 also applies to the second side wall 4*a*2. Thus, the scroll casing 4 is configured such that the scroll side wall height H increases in the rotation direction R from the inner end portion 41*s* to the second expanded portion 41*m*2. That is, the scroll casing 4 is configured such that the distance between the second side wall 4*a*2 and the extension L gradually increases in the rotation direction R of the impeller 2 from the inner end portion 41*s* toward the second expanded portion 41*m*2.

In addition, the scroll casing 4 is configured such that the scroll side wall height H reduces in the rotation direction R from the second expanded portion 41*m*2 to the inner end portion 41*s*. Thus, the scroll casing 4 is configured such that the distance between the second side wall 4*a*2 and the extension L gradually reduces in the rotation direction R of the impeller 2 from the second expanded portion 41*m*2 toward the inner end portion 41*s*.

In addition, the scroll casing 4 is configured such that the scroll side wall height H is constant from the second expanded portion 41*m*2 to the third edge end portion 42*a*21. Thus, the scroll casing 4 is configured such that the distance between the second side wall 4*a*2 and the extension L is constant from the second expanded portion 41*m*2 toward the third edge end portion 42*a*21.

Furthermore, the scroll casing 4 may be configured such that the scroll side wall height H increases from the second expanded portion 41*m*2 to the third edge end portion 42*a*21. Thus, the scroll casing 4 may be configured such that the distance between the second side wall 4*a*2 and the extension L increases from the second expanded portion 41*m*2 toward the third edge end portion 42*a*21.

Furthermore, in the modified scroll casing 4, when the angle at the position of the inner end portion 41*s* in the second side wall 4*a*2 is 0 degrees, a second expansion start portion 41*p*2 is formed between a position at 0 degrees and a position at 180 degrees in the rotation direction R. The expansion start portion 41*p* in the first side wall 4*a*1 and the second expansion start portion 41*p*2 in the second side wall 4*a*2 are formed at the same position in the rotation direction R. However, the configuration of the expansion start portion 41*p* in the first side wall 4*a*1 and the second expansion start portion 41*p*2 in the second side wall 4*a*2 is not limited to the configuration in which they are formed at the same position in the rotation direction R. The expansion start portion 41*p* in the first side wall 4*a*1 and the second expansion start portion 41*p*2 in the second side wall 4*a*2 may be formed at different positions in the rotation direction R.

[Operation Example of Centrifugal Fan 1]

When the impeller 2 rotates, air outside the scroll casing 4 is suctioned into the scroll casing 4 through the air inlets 5 formed at the respective sides of the impeller 2. In this case, the air suctioned into the scroll casing 4 is suctioned into the impeller 2 by being guided through the bell mouths 3. The air suctioned into the impeller 2 becomes, in the process of passing through the spaces between the blades 2*d*, airflow to which a dynamic pressure and a static pressure are imparted, and the airflow is blown out toward the outside of the impeller 2 in radial directions. The dynamic pressure of the airflow blown out from the impeller 2 is converted into a static pressure during the airflow being guided between the inside of the peripheral wall 4*c* and the blades 2*d* in the scroll portion 41. After passing through the scroll portion 41, the airflow is blown outside the scroll casing 4 from the discharge port 42*a* formed in the discharge portion 42. In this case, part of the airflow does not move toward the discharge port 42*a* after passing through the scroll portion 41 but flows again into the scroll portion 41 from the tongue portion 43.

[Operation and Effect of Centrifugal Fan 1]

The scroll casing 4 of the centrifugal fan 1 is configured such that the inner end portion 41*s*, the expanded portion 41*m*, and the first edge end portion 42*a*11 are arranged in a named order in the rotation direction R and such that distance L1≥distance LM>distance LS is satisfied. As a result, air flowing in the scroll casing 4 flows toward the discharge port 42*a* with the pressure thereof increasing due to an increase in the sectional area of the passage along with expansion of the side wall 4*a*. In addition, part of the air toward the inner end portion 41*s* can smoothly flow again to the inner end portion 41*s* due to the height of the first side wall 4*a*1 being reduced such that distance LM>distance LS is satisfied. Furthermore, the scroll casing 4 is configured such that distance L1≥distance LM is satisfied. Thus, the scroll casing 4 is configured without the sectional area of the passage reduced from the expanded portion 41*m* toward the discharge port 42*a* Accordingly, the centrifugal fan 1 having this configuration is capable of efficiently increasing airflow pressure.

In addition, the scroll casing 4 of the centrifugal fan 1 is configured such that the inner end portion 41*s*, the second expanded portion 41*m*2, and the third edge end portion 42*a*21 are arranged in a named order in the rotation direction R and such that distance L3≥distance LM2>distance LS2 is satisfied. As a result, air flowing in the scroll casing 4 flows toward the discharge port 42*a* with the pressure thereof increasing due to an increase in the sectional area of the passage along with expansion of the side wall 4*a*. In addition, part of the air toward the inner end portion 41*s* can smoothly flow again to the inner end portion 41*s* due to the height of the second side wall 4*a*2 being reduced such that distance LM2>distance LS2 is satisfied. Furthermore, the scroll casing 4 is configured such that distance L3≥distance LM2 is satisfied, Thus, the scroll casing 4 is configured without the sectional area of the passage reduced from the second expanded portion 41*m*2 toward the discharge port 42*a*, Accordingly, the centrifugal fan 1 having this configuration is capable of efficiently increasing airflow pressure. In the centrifugal fan 1, the first side wall 4*a*1 and the second side wall 4*a*2 each have the above relationship. Thus, it is possible to make the configuration of the centrifugal fan 1 suitable, in terms of, for example, the air suction amount, for the form of a unit in which the centrifugal fan 1 is to be mounted.

In addition, in the scroll casing 4, the distance between the side wall 4*a* and the extension L gradually increases in the rotation direction R from the inner end portion 41*s* toward the expanded portion 41*m*. Thus, in the centrifugal fan 1, the sectional area of the passage in the scroll casing 4 can be increased with expansion thereof in a radial direction inhibited.

In addition, the expansion start portion 41*p* is formed between a position at 0 degrees and a position at 180 degrees in the rotation direction R. When the centrifugal fan 1 has a configuration in which the side wall 4*a* is expanded, and the amount of suction air flowing in from the vicinity of the inner end portion 41*s* is excessively small, air may not flow sufficiently in the air passage formed between the impeller 2 and the scroll casing 4. Thus, airflow separation occurs everywhere at an inner wall surface of the scroll casing 4, and, actually, this configuration may reduce efficiency. In the centrifugal fan 1, the expansion start portion 41*p* is formed between a position at 0 degrees and a position at 180 degrees in the rotation direction R. Thus, even when the amount of suction air flowing in from the vicinity of the inner end portion 41*s* is excessively small, it is possible to start to expand the side wall 4*a* at a position where there is a certain amount of suction air.

In addition, the scroll casing 4 is configured such that distance L1≥distance L2≥distance LS is satisfied, or the scroll casing 4 is configured such that distance L3≥distance L4≥distance LS2 is satisfied. This configuration of the scroll casing 4 enables an excessive restriction of a discharge flow to be inhibited and enables an airflow velocity increase effect to be reduced.

In addition, the expanded portion 41*m* is formed between, in the rotation direction R, a position at 180 degrees relative to the inner end portion 41*s* and a position where the line connecting the rotation shaft RS and the first edge end portion 42*a*11 forms the first angle θ1, or the second expanded portion 41*m*2 is formed between, in the rotation direction R, a position at 180 degrees relative to the inner end portion 41*s* and a position where the line connecting the rotation shaft RS and the third edge end portion 42*a*21 forms the second angle θ2. Thus, in the centrifugal fan 1, the sectional area of the passage in the scroll casing 4 can be increased with expansion thereof in a radial direction inhibited. Accordingly, air flowing in the scroll casing 4 flows toward the discharge port 42*a* with the pressure thereof increasing with expansion of the side walls 4*a*.

Embodiment 2

[Centrifugal Fan 1A]

Figure 10:
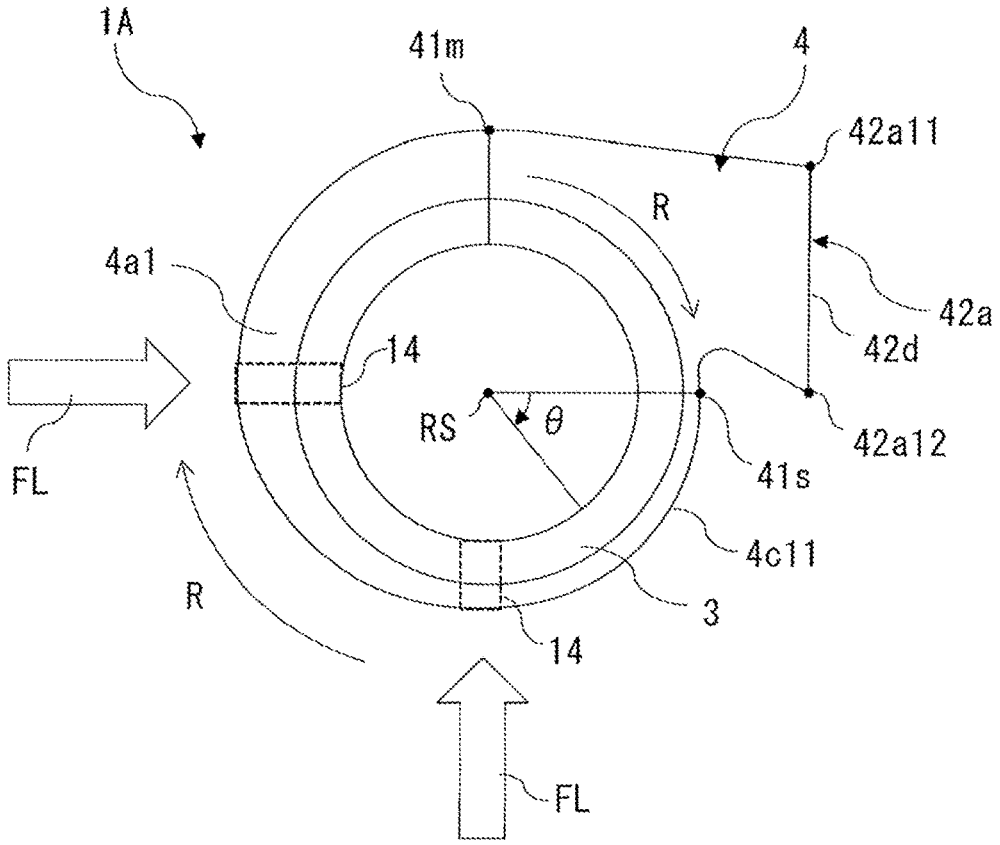
FIG. 10 is a schematic diagram of a centrifugal fan according to Embodiment 2 when viewed in the direction along the rotation shaft RS.
Figure 11:
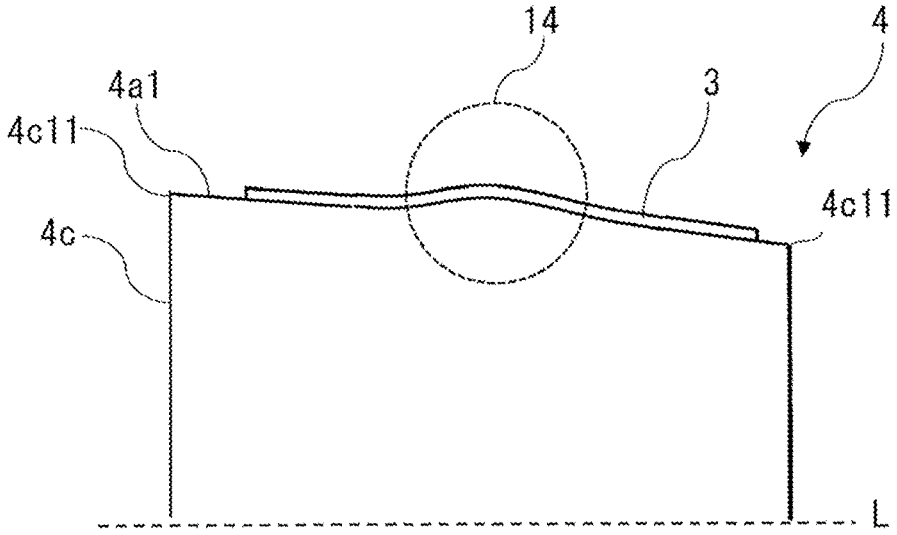
FIG. 11 is a schematic diagram of a bulging portion of the centrifugal fan in FIG. 10 when viewed from one side.

FIG. 10 is a schematic diagram of a centrifugal fan 1A according to Embodiment 2 when viewed in the direction along the rotation shaft RS. FIG. 11 is a schematic diagram of a bulging portion 14 of the centrifugal fan 1A in FIG. 10 when viewed from one side. Components having the same configurations as those of the components of the centrifugal fan 1 in FIGS. 1 to 9 have the same reference signs, and the descriptions thereof are omitted. The centrifugal fan 1A according to Embodiment 2 differs from the centrifugal fan 1 according to Embodiment 1 in the shape of the side wall 4*a*. Thus, the configuration of the side wall 4*a* of the centrifugal fan 1A according to Embodiment 2 will be mainly described below by using FIGS. 10 and 11. Outline arrows FL illustrated in FIG. 10 represent flows of a large amount of suction air.

Figure 14:
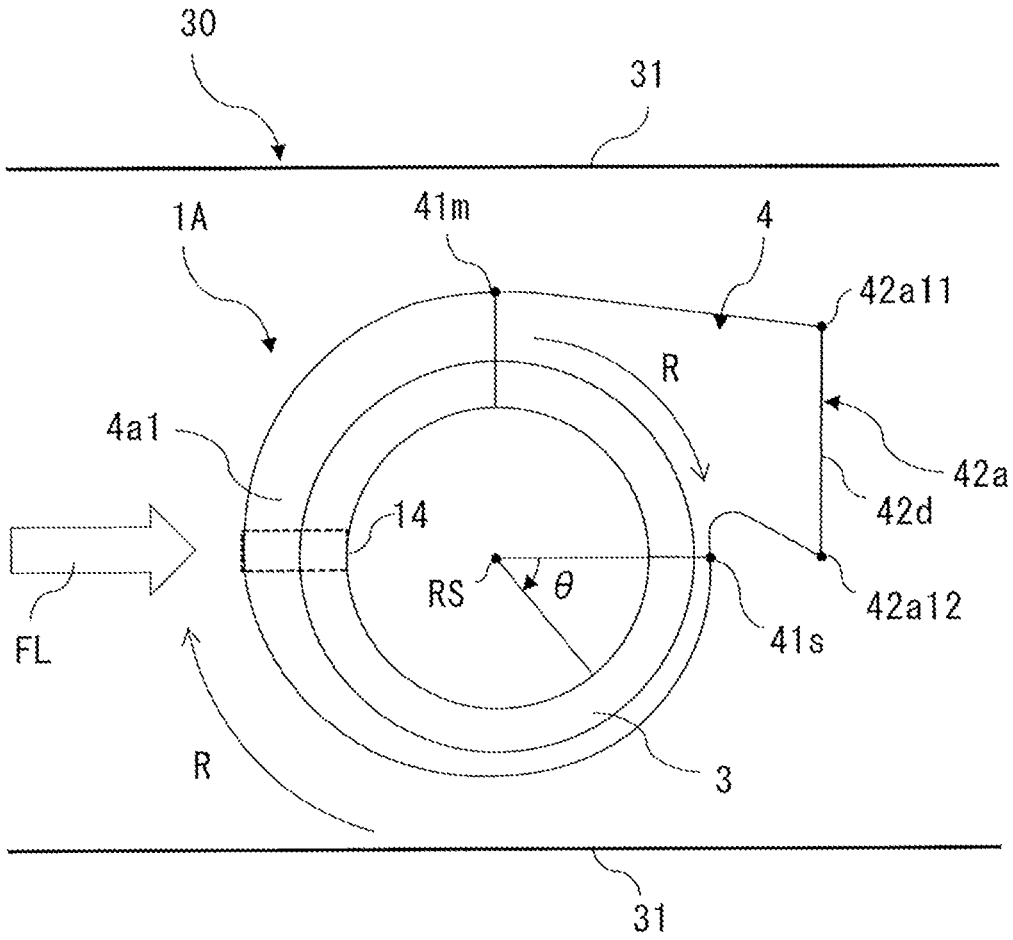
FIG. 14 is a schematic diagram for describing the effect of the bulging portion.

As illustrated in FIGS. 10 and 14, the side wall 4*a* has the bulging portion 14. The bulging portion 14 is a portion of the side wall 4*a* bulging toward a side opposite to the extension L. The bulging portion 14 is formed between the inner end portion 41*s* and the expanded portion 41*m* in the rotation direction R. As illustrated in FIG. 10, the bulging portions 14 are formed at respective positions where a large amount of suction air flows in. The bulging portion 14 is formed to extend in a radial direction of the rotation shaft RS.

The bulging portion 14 may be formed at one of the first side wall 4*a*1 and the second side wall 4*a*2 or at each of the first side wall 4*a*1 and the second side wall 4*a*2. In addition, the position, in the rotation direction R from the inner end portion 41*s*, where the bulging portion 14 is formed at the first side wall 4*a*1 and the position, in the rotation direction R from the inner end portion 41*s*, where the bulging portion 14 is formed at the second side wall 4*a*2 may be the same or different.

Figure 12:
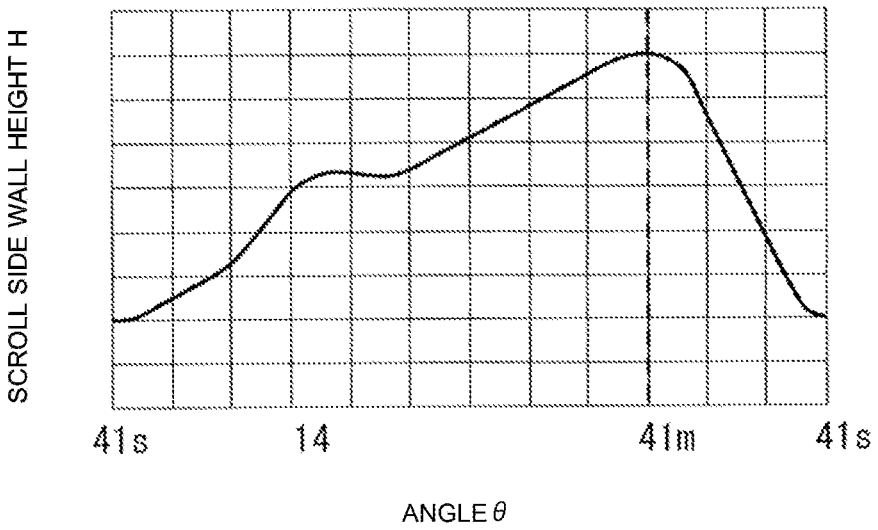
FIG. 12 is a graph illustrating a relationship between a scroll side wall height H and an angle θ in a scroll portion of the centrifugal fan according to Embodiment 2.
Figure 13:
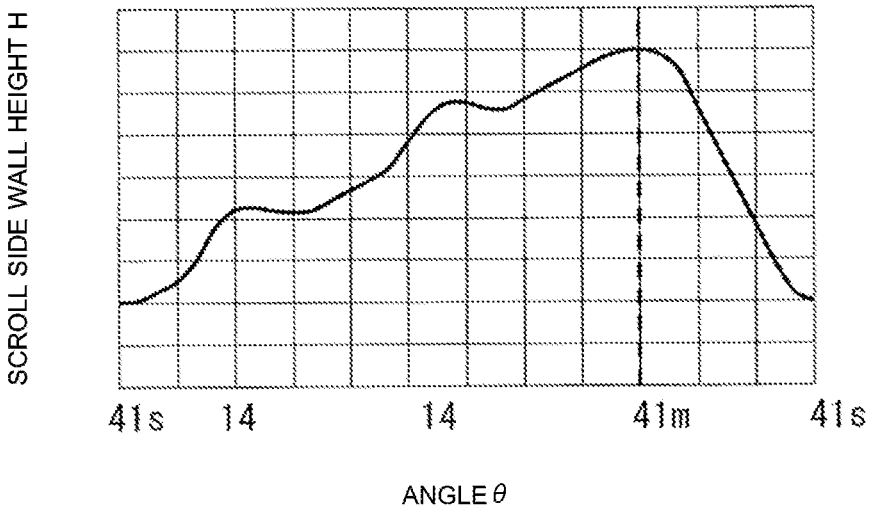
FIG. 13 is a graph illustrating a relationship between a scroll side wall height H and an angle θ in another scroll portion of the centrifugal fan according to Embodiment 2.

FIG. 12 is a graph illustrating a relationship between a scroll side wall height H and an angle θ in a scroll portion 41 of the centrifugal fan 1A according to Embodiment 2, FIG. 13 is a graph illustrating a relationship between a scroll side wall height H and an angle θ in another scroll portion 41 of the centrifugal fan 1A according to Embodiment 2. As illustrated in FIGS. 12 and 13, the bulging portion 14 is a portion at which a predetermined rate of change at which the scroll side wall height H increases from the inner end portion 41*s* to the expanded portion 41*m* partly changes. The bulging portion 14 is formed according to a locally increased amount of suction air. As illustrated in FIGS. 12 and 13, the number of the bulging portions 14 to be formed may be one or more than one. In addition, as illustrated in FIGS. 10 and 11, the bulging portion 14 may also be formed at the bell mouth 3. Furthermore, although FIG. 10 illustrates the form in which the bulging portion 14 is formed throughout a part of the first side wall 4*a*1 (side wall 4*a*) in a radial direction, the bulging portion 14 may be formed only in a part of a region of a part of the first side wall 4*a*1 (side wall 4*a*) in a radial direction. Similarly, the bulging portion 14 may be formed only in a part of a region of a part of the second side wall 4*a*2 (side wall 4*a*) in a radial direction.

[Operation and Effect of Centrifugal Fan 1A]

FIG. 14 is a schematic diagram for describing the effect of the bulging portion 14. In FIG. 14, the centrifugal fan 1A according to Embodiment 2 is provided in a unit 30. The centrifugal fan 1A is provided between walls 31 of the unit 30. Air nonuniformly flows into the centrifugal fan 1A mounted in the unit 30 due to an air passage in the unit 30. When FIG. 14 is taken as an example, air flows in a direction from the left, and the amount of suction air thus tends to increase at a position at 180 degrees relative to the inner end portion 41*s* in the rotation direction R. For this reason, when the side wall 4*a* expands in the direction along the rotation shaft RS at a constant rate of expansion, the velocity of airflow may be increased in an air passage formed between the impeller 2 and the scroll casing due to insufficient expansion of the side wall 4*a*. The bulging portion 14 is provided in a suction direction, and the passage is expanded by partly changing the rate of expansion of the side wall 4*a* in the direction along the rotation shaft RS. As a result, the centrifugal fan 1A is capable of inhibiting an increase in the velocity of airflow and efficiently performing conversion into a pressure.

Embodiment 3

[Centrifugal Fan 1B]

Figure 15:
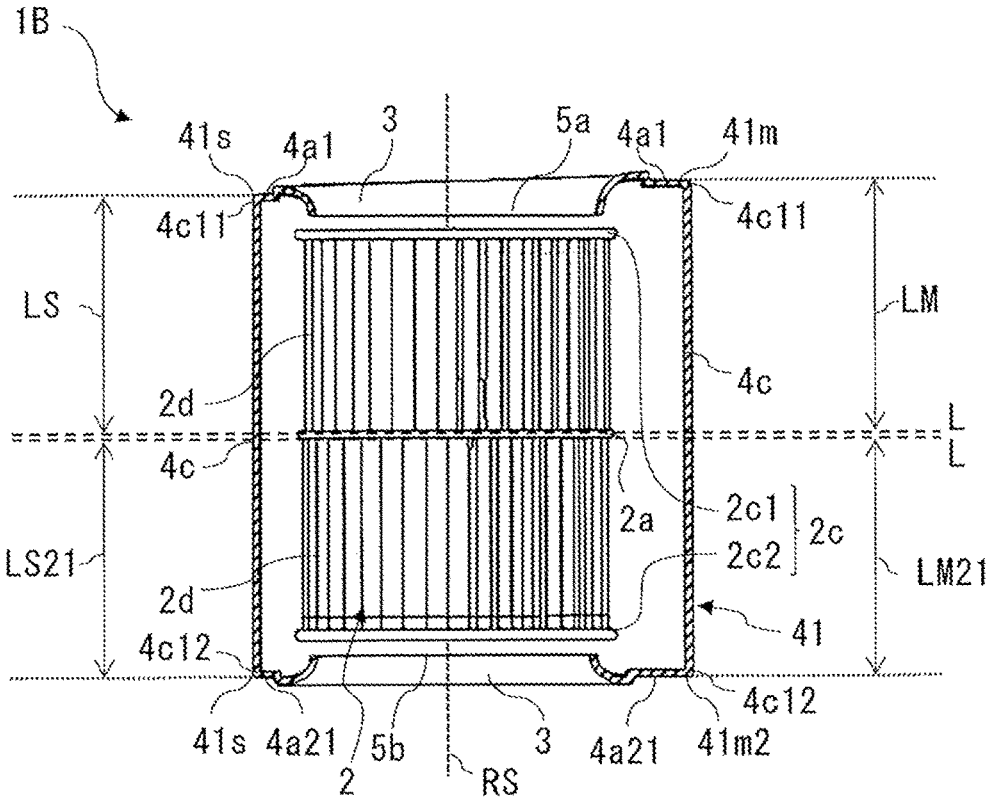
FIG. 15 is a sectional view of a centrifugal fan according to Embodiment 3 taken along line S-M corresponding to that in the centrifugal fan in FIG. 2.

FIG. 15 is a sectional view of a centrifugal fan 1B according to Embodiment 3 taken along line S-M corresponding to that in the centrifugal fan 1 in FIG. 2. Components having the same configurations as those of the components of the centrifugal fan 1 and another centrifugal fan in FIGS. 1 to 14 have the same reference signs, and the descriptions thereof are omitted. The centrifugal fan 1B according to Embodiment 3 differs from the centrifugal fan 1 according to Embodiment 1 in the shape of the second side wall 4*a*2. Thus, the configuration of the side wall 4*a* of the centrifugal fan 1B according to Embodiment 3 will be mainly described below by using FIG. 15.

The scroll casing 4 of the centrifugal fan 1B according to Embodiment 3 includes a second side wall 4*a*21 extending along the second edge 4*c*12 of the peripheral wall 4*c*, the second edge 4*c*12 being at the other end, in the axial direction of the rotation shaft RS, of the peripheral wall 4*c*, the second side wall 4*a*21 facing the extension L, the second side wall 4*a*21 having the second air inlet 5*b* defined therein and configured to let air in. A distance LM21 is the distance between the second side wall 4*a*21 at the second expanded portion 41*m*2 and the extension L. A distance LS21 is the distance between the second side wall 4*a*21 at the inner end portion 41*s* of the volute shape and the extension L. The centrifugal fan 1B has the relationship that the distance LM21 is substantially equal to the distance LS21. That is, the distance between the second side wall 4*a*21 and the extension L is substantially constant in the rotation direction R. In the centrifugal fan 1B, the feature in which the side wall 4*a* is expanded in the direction along the rotation shaft RS is applied only to the first side wall 4*a*1. The centrifugal fan 1B includes the scroll casing 4 whose respective suction sides have different shapes.

[Operation and Effect of Centrifugal Fan 1B]

When the centrifugal fan 1 according to Embodiment 1 is mounted in a unit, and, for example, an obstacle exists at one of the side walls 4*a*, the respective amounts of air suctioned by the left side and the right side of the centrifugal fan 1 are different from each other. In this case, when the feature in which the side wall 4*a* is expanded in the direction along the rotation shaft RS is applied to the side wall 4*a* at which the amount of suction air is small, the passage in the scroll casing 4 of the centrifugal fan 1 is expanded excessively to be out of proportion to the amount of air. In this case, airflow separation may occur at the inner wall surface of the scroll casing 4 of the centrifugal fan 1. On the other hand, in the centrifugal fan 1B, the distance between the second side wall 4*a*21 and the extension L is constant in the rotation direction R. In the centrifugal fan 1B, application of the second side wall 4*a*21 to the side wall 4*a* at which the amount of suction air is small enables the passage in the scroll casing 4 to have an area appropriate for the amount of air. As a result, the centrifugal fan 1B is capable of inhibiting airflow separation from occurring at the inner wall surface of the scroll casing 4.

Embodiment 4

[Centrifugal Fan 10]

Figure 16:
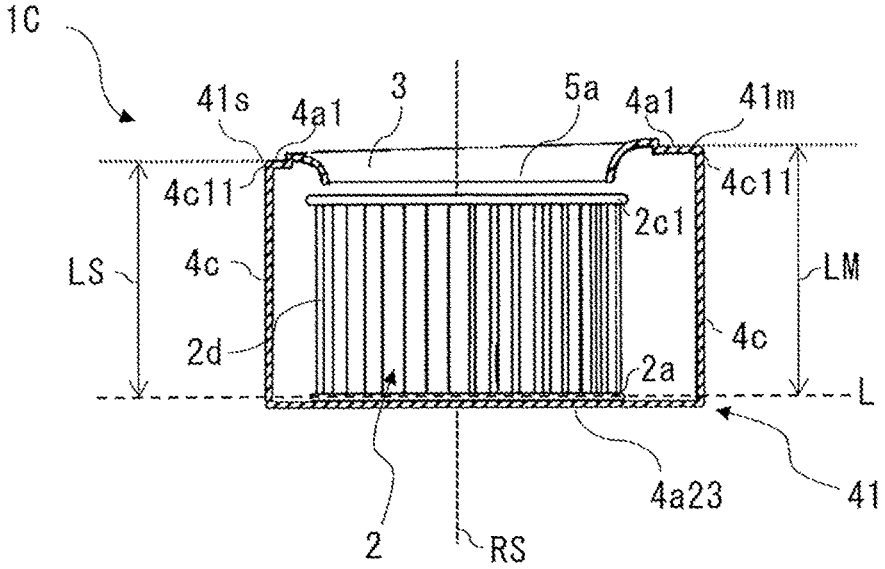
FIG. 16 is a sectional view of a centrifugal fan according to Embodiment 4 taken along line S-M corresponding to that in the centrifugal fan in FIG. 2.

FIG. 16 is a sectional view of a centrifugal fan 10 according to Embodiment 4 taken along line S-M corresponding to that in the centrifugal fan 1 in FIG. 2. Components having the same configurations as those of the components of the centrifugal fan 1 and other centrifugal fans in FIGS. 1 to 15 have the same reference signs, and the descriptions thereof are omitted. The centrifugal fan 1C according to Embodiment 4 differs from the centrifugal fan 1 according to Embodiment 1 in the shape of the second side wall 4*a*2. Thus, the configuration of the side wall 4*a* of the centrifugal fan 10 according to Embodiment 4 will be mainly described below by using FIG. 16.

The scroll casing 4 of the centrifugal fan 10 according to Embodiment 4 includes a second side wall 4*a*23 extending along the second edge 4*c*12 of the peripheral wall 4*c*, the second edge 4*c*12 being at the other end, in the axial direction of the rotation shaft RS, of the peripheral wall 4*c*, the second side wall 4*a*23 facing the extension L. The second side wall 4*a*23 is formed to surround the impeller 2 in the axial direction of the rotation shaft RS. The second side wall 4*a*23 has a plate-like shape. The second side wall 4*a*23 does not have the air inlet 5. In the centrifugal fan 10, the feature in which the side wall 4*a* is expanded in the direction along the rotation shaft RS is applied only to the first side wall 4*a*1. The centrifugal fan 10 includes the scroll casing 4 that is a single suction scroll casing.

[Operation and Effect of Centrifugal Fan 10]

The first side wall 4*a*1 of the centrifugal fan 10 according to Embodiment 4 and the first side wall 4*a*1 of the centrifugal fan 1 according to Embodiment 1 have the same configuration. Thus, the centrifugal fan 10 according to Embodiment 4 including the scroll casing 4 that is a single suction scroll casing is capable of achieving an effect similar to that of the centrifugal fan 1 according to Embodiment 1.

Embodiment 5

[Air-conditioning Apparatus 40]

Figure 17:
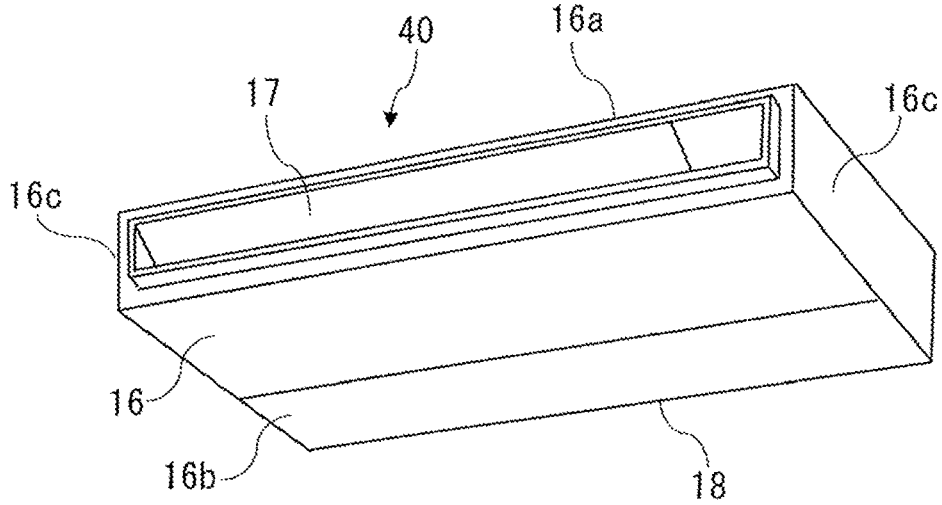
FIG. 17 is a perspective view schematically illustrating an example of an air-conditioning apparatus according to Embodiment 5.
Figure 18:
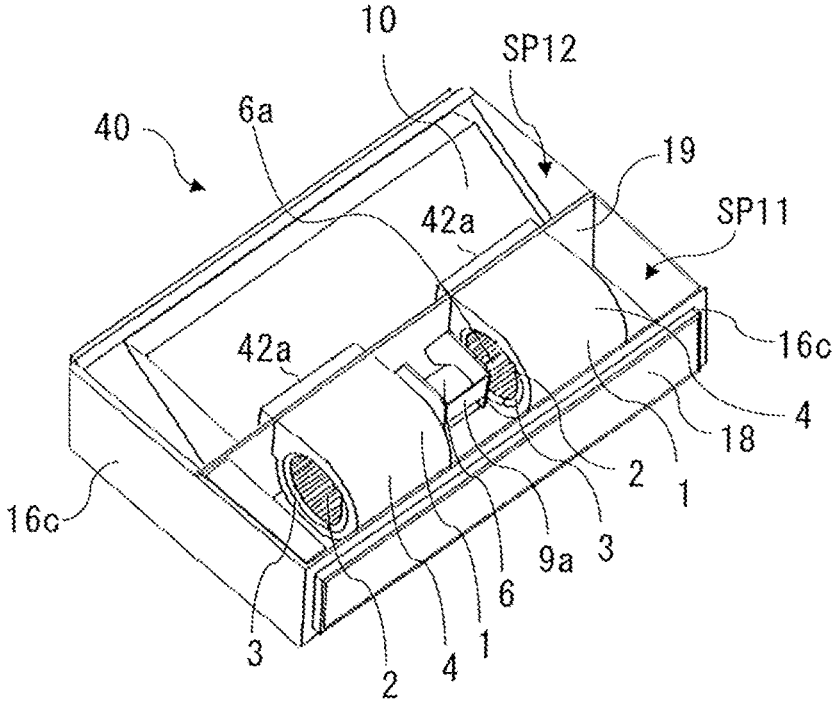
FIG. 18 is a schematic diagram illustrating an example of the internal configuration of the air-conditioning apparatus according to Embodiment 5.

FIG. 17 is a perspective view schematically illustrating an example of an air-conditioning apparatus 40 according to Embodiment 5. FIG. 18 is a schematic diagram illustrating an example of the internal configuration of the air-conditioning apparatus 40 according to Embodiment 5. Components having the same configurations as those of the components of the centrifugal fan 1 and other centrifugal fans in FIGS. 1 to 16 have the same reference signs, and the descriptions thereof are omitted. FIG. 18 does not illustrate a top portion 16*a* to illustrate the internal configuration of the air-conditioning apparatus 40. The air-conditioning apparatus 40 according to Embodiment 5 includes one or more of the centrifugal fan 1, the centrifugal fan 1A, the centrifugal fan 1B, and the centrifugal fan 10, and a heat exchanger 10, which is provided to face the discharge port 42*a* of, for example, the centrifugal fan 1. In addition, the air-conditioning apparatus 40 according to Embodiment 5 includes a case 16, which is provided above a ceiling of an air-conditioned room. In the following description, the term "centrifugal fan 1" denotes one of the centrifugal fan 1, the centrifugal fan 1A, the centrifugal fan 1B, and the centrifugal fan 1C.

As illustrated in FIG. 17, the case 16 includes the top portion 16*a*, a bottom portion 16*b*, and side portions 16*c*, and has a cuboid shape. The shape of the case 16 is not limited to a cuboid shape and may be a different shape such as a cylindrical shape, a rectangular column shape, a circular cone shape, a shape having a plurality of corners, or a shape having a plurality of curved surfaces. The case 16 includes, as one of the side portions 16*c*, a side portion 16*c* having a case discharge port 17. As illustrated in FIG. 17, the case discharge port 17 and a case air inlet 18 each have a rectangular shape. Each shape of the case discharge port 17 and the case air inlet 18 is not limited to a rectangular shape and may be a different shape such as a circular shape or an oval shape. The case 16 includes, as one of the side portions 16*c*, a side portion 16*c* having the case air inlet 18, which is a side opposite to the side having the case discharge port 17. A filter configured to remove dust in the air may be provided at the case air inlet 18. It is sufficient to form the case air inlet 18 at a position perpendicular to the axial direction of the rotation shaft RS of the centrifugal fan 1. Thus, for example, the bottom portion 16*b* may have the case air inlet 18.

The case 16 accommodates two centrifugal fans 1, a motor 6, and the heat exchanger 10. The centrifugal fans 1 each include the scroll casing 4 including the impeller 2 and the bell mouth 3. The motor 6 is supported by a motor support 9*a*, which is fixed to the top portion 16*a* of the case 16. The motor 6 has an output shaft 6*a*. The output shaft 6*a* is provided to extend in parallel with the side having the case air inlet 18 and the side having the case discharge port 17 of the side portions 16*c*. As illustrated in FIG. 18, in the air-conditioning apparatus 40, the two impellers 2 are attached to the output shaft 6*a*. The impellers 2 form airflow to be suctioned into the case 16 from the case air inlet 18 and blown out into an air-conditioned space from the case discharge port 17. The number of the centrifugal fans 1 to be provided in the case 16 is not limited to two and may be one or three or more.

As illustrated in FIG. 18, the centrifugal fans 1 are attached to a partition plate 19. The partition plate 19 partitions the internal space of the case 16 into a space SP11, which is at the suction sides of the scroll casings 4, and a space SP12, which is at the discharge sides of the scroll casings 4.

The heat exchanger 10 is provided to face the discharge ports 42*a* of the centrifugal fans 1. The heat exchanger 10 is provided in an air passage in the case 16 for air discharged by the centrifugal fans 1. The heat exchanger 10 adjusts the temperature of air suctioned into the case 16 from the case air inlet 18 and to be blown out into an air-conditioned space from the case discharge port 17. A heat exchanger having a known structure is applicable to the heat exchanger 10.

[Operation Example of Air-Conditioning Apparatus 40]

When the impellers 2 are rotated by driving the motor 6, air in an air-conditioned space is suctioned into the case 16 through the case air inlet 18. The air suctioned into the case 16 is guided into the bell mouths 3 and suctioned into the impellers 2. The air suctioned into the impellers 2 is blown out in radial directions of the impellers 2. The air blown out from the impellers 2 passes through the scroll casings 4, is blown out from the discharge ports 42*a* of the scroll casings 4, and is then supplied to the heat exchanger 10. The air supplied to the heat exchanger 10 is subjected to heat exchange during passing through the heat exchanger 10, and the temperature and humidity of the air are adjusted. The air that has passed through the heat exchanger 10 is blown out into the air-conditioned space from the case discharge port 17.

[Operation and Effect of Air-Conditioning Apparatus 40]

The air-conditioning apparatus 40 according to Embodiment 5 includes, for example, the centrifugal fan 1 according to Embodiment 1 and is thus capable of achieving an effect similar to that of the centrifugal fan 1 according to Embodiment 1. Accordingly, for example, the air-conditioning apparatus 40 is capable of sending, to the heat exchanger 10, air whose pressure has been efficiently increased by the centrifugal fan 1.

Embodiment 6

[Refrigeration Cycle Apparatus 50]

Figure 19:
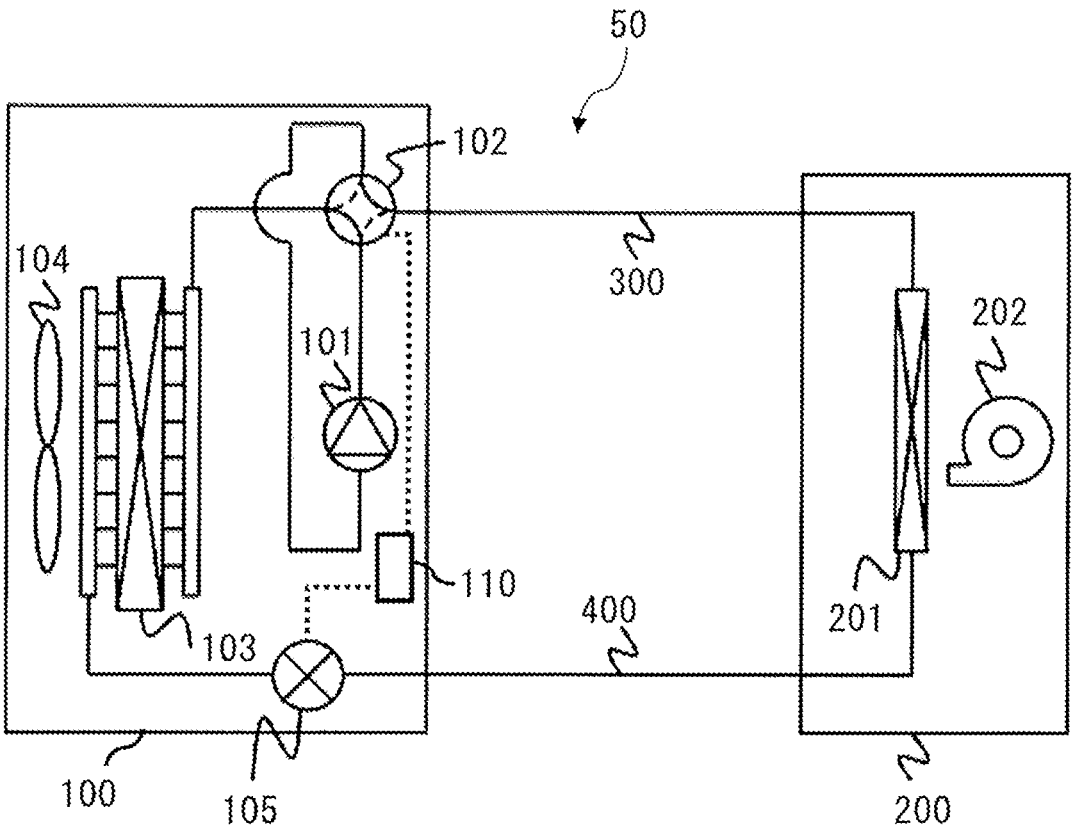
FIG. 19 is a diagram illustrating the configuration of a refrigeration cycle apparatus according to Embodiment 6.

FIG. 19 is a diagram illustrating the configuration of a refrigeration cycle apparatus 50 according to Embodiment 6. One or more of the centrifugal fan 1, the centrifugal fan 1A, the centrifugal fan 1B, and the centrifugal fan 10 are usable for an indoor fan 202 of the refrigeration cycle apparatus 50 according to Embodiment 6. Although a case in which the refrigeration cycle apparatus 50 is used for air conditioning will be described below, the refrigeration cycle apparatus 50 is not limited to being used for air conditioning. For example, the refrigeration cycle apparatus 50 is usable for refrigeration or air conditioning in a refrigerator, a freezer, a vending machine, an air-conditioning apparatus, a refrigeration apparatus, a hot-water supply apparatus, or other apparatuses.

The refrigeration cycle apparatus 50 according to Embodiment 6 performs air conditioning by transferring heat between outdoor air and indoor air via refrigerant to heat or cool an indoor space. The refrigeration cycle apparatus 50 according to Embodiment 6 includes an outdoor unit 100 and an indoor unit 200. In the refrigeration cycle apparatus 50, a refrigerant circuit in which refrigerant circulates is formed by connecting the outdoor unit 100 and the indoor unit 200 by refrigerant pipes 300 and 400. The refrigerant pipe 300 is a gas pipe in which gas phase refrigerant flows. The refrigerant pipe 400 is a liquid pipe in which liquid phase refrigerant flows. Two-phase gas-liquid refrigerant may flow in the refrigerant pipe 400. In the refrigerant circuit of the refrigeration cycle apparatus 50, a compressor 101, a flow switching device 102, an outdoor heat exchanger 103, an expansion valve 105, and an indoor heat exchanger 201 are successively connected via refrigerant pipes.

(Outdoor Unit 100)

The outdoor unit 100 includes the compressor 101, the flow switching device 102, the outdoor heat exchanger 103, and the expansion valve 105. The compressor 101 compresses and discharges suctioned refrigerant. The flow switching device 102 is, for example, a four-way valve, that is, a device configured to switch between directions in which refrigerant flows. The refrigeration cycle apparatus 50 is capable of realizing a heating operation or a cooling operation by switching refrigerant flows with the flow switching device 102 on the basis of instructions from a controller 110.

The outdoor heat exchanger 103 exchanges heat between refrigerant and outdoor air. The outdoor heat exchanger 103 functions as an evaporator in the heating operation and exchanges heat between low-pressure refrigerant flowing in through the refrigerant pipe 400 and outdoor air to evaporate and gasify the refrigerant. The outdoor heat exchanger 103 functions as a condenser in the cooling operation and exchanges heat between outdoor air and refrigerant that has been compressed by the compressor 101 and that has flowed in from the flow switching device 102 to condense and liquify the refrigerant. An outdoor fan 104 is provided at the outdoor heat exchanger 103 to increase the efficiency of heat exchange between refrigerant and outdoor air. An inverter may be attached to the outdoor fan 104, and the operating frequency of a fan motor may be varied by the inverter to vary the rotation speed of the fan. The expansion valve 105 is an expansion device (flow control unit). The expansion valve 105 functions as an expansion valve by adjusting the amount of refrigerant flowing through the expansion valve 105. The expansion valve 105 adjusts refrigerant pressure by varying the opening degree thereof. For example, when the expansion valve 105 is formed by an electronic expansion valve, the opening degree is adjusted on the basis of instructions from the controller 110.

(Indoor Unit 200)

The indoor unit 200 includes the indoor heat exchanger 201, which is configured to exchange heat between refrigerant and indoor air, and the indoor fan 202, which is configured to adjust the flow of air to be subjected to heat exchange in the indoor heat exchanger 201, The indoor heat exchanger 201 functions as a condenser in the heating operation and exchanges heat between indoor air and refrigerant flowing in through the refrigerant pipe 300 to condense and liquify the refrigerant, and the refrigerant then flows out toward the refrigerant pipe 400. The indoor heat exchanger 201 functions as an evaporator in the cooling operation and exchanges heat between indoor air and refrigerant whose pressure is reduced by the expansion valve 105 to evaporate and gasify the refrigerant that has received heat of the air, and the refrigerant then flows out toward the refrigerant pipe 300. The indoor fan 202 is provided to face the indoor heat exchanger 201. One or more of the centrifugal fan 1 according to Embodiment 1 to the centrifugal fan 1 to the centrifugal fan 1C according to Embodiment 4 are applicable to the indoor fan 202. The operating speed of the indoor fan 202 is determined by user settings. An inverter may be attached to the indoor fan 202, and the operating frequency of a fan motor (not illustrated) may be varied by the inverter to vary the rotation speed of the impeller 2.

[Operation Example of Refrigeration Cycle Apparatus 50]

Next, the cooling operation will be described as an operation example of the refrigeration cycle apparatus 50. High-temperature, high-pressure gas refrigerant compressed and discharged by the compressor 101 flows into the outdoor heat exchanger 103 via the flow switching device 102. The gas refrigerant that has flowed into the outdoor heat exchanger 103 is condensed into low-temperature refrigerant by being subjected to heat exchange with outdoor air sent by the outdoor fan 104, and the low-temperature refrigerant flows out from the outdoor heat exchanger 103. The refrigerant that has flowed out from the outdoor heat exchanger 103 is expanded and decompressed into low-temperature, low-pressure two-phase gas-liquid refrigerant by the expansion valve 105. The two-phase gas-liquid refrigerant flows into the indoor heat exchanger 201 of the indoor unit 200 and is evaporated into low-temperature, low-pressure gas refrigerant by being subjected to heat exchange with indoor air sent by the indoor fan 202, and the low-temperature, low-pressure gas refrigerant flows out from the indoor heat exchanger 201. In this case, the indoor air that has been cooled by removing heat by the refrigerant becomes conditioned air, and the conditioned air is blown out into an air-conditioned space from a discharge port of the indoor unit 200, The gas refrigerant that has flowed out from the indoor heat exchanger 201 is suctioned into the compressor 101 via the flow switching device 102 and is compressed again. A series of the above operations is repeated.

Next, the heating operation will be described as an operation example of the refrigeration cycle apparatus 50. High-temperature, high-pressure gas refrigerant compressed and discharged by the compressor 101 flows into the indoor heat exchanger 201 of the indoor unit 200 via the flow switching device 102. The gas refrigerant that has flowed into the indoor heat exchanger 201 is condensed into low-temperature refrigerant by being subjected to heat exchange with indoor air sent by the indoor fan 202, and the low-temperature refrigerant flows out from the indoor heat exchanger 201. In this case, the indoor air that has been heated by receiving heat from the gas refrigerant becomes conditioned air, and the conditioned air is blown out into an air-conditioned space from the discharge port of the indoor unit 200. The refrigerant that has flowed out from the indoor heat exchanger 201 is expanded and decompressed into low-temperature, low-pressure two-phase gas-liquid refrigerant by the expansion valve 105. The two-phase gas-liquid refrigerant flows into the outdoor heat exchanger 103 of the outdoor unit 100 and is evaporated into low-temperature, low-pressure gas refrigerant by being subjected to heat exchange with outdoor air sent by the outdoor fan 104, and the low-temperature, low-pressure gas refrigerant flows out from the outdoor heat exchanger 103. The gas refrigerant that has flowed out from the outdoor heat exchanger 103 is suctioned into the compressor 101 via the flow switching device 102 and is compressed again. A series of the above operations is repeated.

The refrigeration cycle apparatus 50 according to Embodiment 6 includes, for example, the centrifugal fan 1 according to Embodiment 1 and is thus capable of achieving an effect similar to that of the centrifugal fan 1 according to Embodiment 1, Accordingly, for example, the refrigeration cycle apparatus 50 is capable of sending, to the indoor heat exchanger 201, air whose pressure has been efficiently increased by the indoor fan 202.

Combinations of Embodiments 1 to 6 described above can be implemented. The configurations in the embodiments above are examples. Thus, the configurations can be combined with other known techniques, and some of the configurations can be omitted or modified without departing from the gist.

REFERENCE SIGNS LIST

1: centrifugal fan, 1A: centrifugal fan, 1B: centrifugal fan, 1C: centrifugal fan, 2: impeller, 2*a*: back plate, 2*a*1: peripheral portion, 2*b*: axial portion, 2*c*: side plate, 2*c*1: first side plate, 2*c*2: second side plate, 2*d*: blade, 2*e*: air inlet, 3: bell mouth, 4: scroll casing, 4*a*: side wall, 4*a*1: first side wall, 4*a*2: second side wall, 4*a*21: second side wall, 4*a*23: second side wall, 4*c*: peripheral wall, 4*c*11: first edge, 4*c*12: second edge, 5: air inlet, 5*a*: first air inlet, 5*b*: second air inlet, 6: motor, 6*a*: output shaft, 9*a*: motor support, 10: heat exchanger, 14: bulging portion, 16: case, 16*a*: top portion, 16*b*: bottom portion, 16*c*: side portion, 17: case discharge port, 18: case air inlet, 19: partition plate, 30: unit, 31: wall, 40: air-conditioning apparatus, 41: scroll portion, 41*b*: outer end portion, 41*m*: expanded portion, 41*m*2: second expanded portion, 41*p*: expansion start portion, 41*p*2: second expansion start portion, 41*s*: inner end portion, 42: discharge portion, 42*a*: discharge port, 42*a*11: first edge end portion, 42*a*12: second edge end portion, 42*a*21: third edge end portion, 42*a*22: fourth edge end portion, 42*b*: extended plate, 42*c*: diffuser plate, 42*d*: first edge, 42*e*: second edge, 43: tongue portion, 50: refrigeration cycle apparatus, 100: outdoor unit, 101: compressor, 102: flow switching device, 103: outdoor heat exchanger, 104: outdoor fan, 105: expansion valve, 110: controller, 200: indoor unit, 201: indoor heat exchanger, 202: indoor fan, 300: refrigerant pipe, 400: refrigerant pipe

The invention claimed is:

1. A centrifugal fan comprising:

an impeller having a back plate driven to rotate; and a scroll casing including a peripheral wall provided in parallel with an axial direction of a rotation shaft of the back plate to surround the impeller, and having a volute shape along a rotation direction of the back plate, a first side wall extending along a first edge of the peripheral wall, the first edge of the peripheral wall being at one end, in the axial direction of the rotation shaft, of the peripheral wall, the first side wall facing a virtual extension of the back plate, the virtual extension of the back plate being perpendicular to the rotation shaft, the first side wall having a first air inlet defined therein and configured to let air in, and a discharge port from which airflow generated by the impeller is discharged, the scroll casing including a bell mouth at the first air inlet and being configured such that an upper portion of the bell mouth that constitutes an outer periphery of the bell mouth projects above the first side wall in any position in a circumferential direction thereof, the scroll casing being configured such that an inner end portion of the volute shape of the scroll casing, an expanded portion, and a first edge end portion are arranged in a named order in the rotation direction, the first edge end portion being an end of a first edge, defining the discharge port, of the first side wall, the first edge end portion being farther from the rotation shaft than an other end of the first edge of the first sidewall is to the rotation shaft, and distance L1≥distance LM>distance LS is satisfied where LS is a distance between the first side wall at the inner end portion of the volute shape and the virtual extension of the back plate, LM is a distance between the first side wall at the expanded portion and the virtual extension of the back plate, the expanded portion being a portion at which the distance between the first side wall and the virtual extension of the back plate is larger than LS, and L1 is a distance between the first side wall at the first edge end portion and the virtual extension of the back plate.

2. The centrifugal fan of claim 1, wherein the scroll casing is configured such that the distance between the first side wall and the virtual extension gradually increases in the rotation direction from the inner end portion toward the expanded portion.

3. The centrifugal fan of claim 2, wherein when an expansion start portion is a portion at which the distance between the first side wall and the virtual extension starts to increase in the rotation direction, and an angle at a position of the inner end portion is 0 degrees, the expansion start portion is formed between a position at 0 degrees and a position at 180 degrees in the rotation direction.

4. The centrifugal fan of claim 1, wherein the scroll casing is configured such that distance L1≥distance L2 ≥distance LS is satisfied where L2 is a distance between the first side wall at a second edge end portion and the virtual extension, the second edge end portion being the other end of the first edge of the first side wall, the second edge end portion being closer to the rotation shaft.

5. The centrifugal fan of claim 1, wherein the expanded portion is formed between, in the rotation direction, a position at 180 degrees relative to the inner end portion and a position where a line connecting the rotation shaft and the first edge end portion forms a first angle.

6. The centrifugal fan of claim 1, wherein the first side wall has a bulging portion bulging toward a side opposite to the virtual extension.

7. The centrifugal fan of claim 6, wherein the bulging portion is formed to extend in a radial direction of the rotation shaft.

8. The centrifugal fan of claim 7, wherein a plurality of bulging portions, each of which is the bulging portion, are formed at positions in the rotation direction.

9. The centrifugal fan of claim 1, wherein the scroll casing further includes a second side wall extending along a second edge of the peripheral wall, the second edge being at an other end, in the axial direction, of the peripheral wall, the second side wall facing the virtual extension, the second side wall having a second air inlet defined therein and configured to let air in, and the scroll casing is configured such that the inner end portion, a second expanded portion, and a third edge end portion are arranged in a named order in the rotation direction, the third edge end portion being an end of a second edge, defining the discharge port, of the second side wall, the third edge end portion being farther from the rotation shaft than an other end of the second edge is to the rotation shaft, and distance L3≥distance LM2>distance LS2 is satisfied where LS2 is a distance between the second side wall at the inner end portion and the virtual extension, LM2 is a distance between the second side wall at the second expanded portion and the virtual extension, the second expanded portion being a portion at which the distance between the second side wall and the virtual extension is larger than LS2, and L3 is a distance between the second side wall at the third edge end portion, and the virtual extension.

10. The centrifugal fan of claim 9, wherein the scroll casing is configured such that the distance between the second side wall and the virtual extension gradually increases in the rotation direction from the inner end portion toward the second expanded portion.

11. The centrifugal fan of claim 10, wherein when a second expansion start portion is a portion at which the distance between the second side wall and the virtual extension starts to increase in the rotation direction, and an angle at the position of the inner end portion is 0 degrees, the second expansion start portion is formed between a position at 0 degrees and a position at 180 degrees in the rotation direction.

12. The centrifugal fan of claim 9, wherein the scroll casing is configured such that distance L3≥distance L4≥distance LS2 is satisfied where L4 is a distance between the second side wall at a fourth edge end portion and the virtual extension, the fourth edge end portion being the other end of the second edge, the fourth edge end portion being closer to the rotation shaft.

13. The centrifugal fan of claim 9, wherein the second expanded portion is formed between, in the rotation direction, a position at 180 degrees relative to the inner end portion and a position where a line connecting the rotation shaft and the third edge end portion forms a second angle.

14. The centrifugal fan of claim 9, wherein the second side wall has a bulging portion bulging toward a side opposite to the virtual extension.

15. The centrifugal fan of claim 1, wherein the scroll casing further includes a second side wall extending along a second edge of the peripheral wall, the second edge being at an other end, in the axial direction, of the peripheral wall, the second side wall facing the virtual extension, the second side wall having a second air inlet defined therein and configured to let air in, and a distance between the second side wall and the virtual extension is constant in the rotation direction.

16. The centrifugal fan of claim 1, wherein the scroll casing further includes a second side wall extending along a second edge of the peripheral wall, the second edge being at an other end, in the axial direction, of the peripheral wall, the second side wall facing the virtual extension, and the second side wall is formed to surround the impeller in the axial direction.

17. An air-conditioning apparatus comprising:

the centrifugal fan of claim 1; and a heat exchanger provided to face the discharge port of the centrifugal fan.

18. A refrigeration cycle apparatus comprising the centrifugal fan of claim 1.

* * * * *